US009909271B2

(12) United States Patent
Wiegel et al.

(10) Patent No.: US 9,909,271 B2
(45) Date of Patent: Mar. 6, 2018

(54) SHOCK ABSORBING RETRACTABLE BOLLARD SYSTEMS

(71) Applicants: Aaron J. Wiegel, Benton, WI (US); David Swift, Dubuque, IA (US); Jason Dondlinger, Bellevue, IA (US); Joe Korman, Dubuque, IA (US); Lucas I. Paruch, Dubuque, IA (US); Ronald P. Snyder, Dubuque, IA (US)

(72) Inventors: Aaron J. Wiegel, Benton, WI (US); David Swift, Dubuque, IA (US); Jason Dondlinger, Bellevue, IA (US); Joe Korman, Dubuque, IA (US); Lucas I. Paruch, Dubuque, IA (US); Ronald P. Snyder, Dubuque, IA (US)

(73) Assignee: RITE-HITE HOLDING CORPORATION, Milwaukee, WI (US)

( * ) Notice: Subject to any disclaimer, the term of this patent is extended or adjusted under 35 U.S.C. 154(b) by 88 days.

(21) Appl. No.: 14/939,602

(22) Filed: Nov. 12, 2015

(65) Prior Publication Data

US 2017/0138006 A1 May 18, 2017

(51) Int. Cl.

| | |
|---|---|
| ***E01F 15/00*** | (2006.01) |
| ***E01F 13/04*** | (2006.01) |
| ***E01F 9/646*** | (2016.01) |

(52) U.S. Cl.

CPC ..... *E01F 13/046* (2013.01); *E01F 9/646* (2016.02); *E01F 15/003* (2013.01)

(58) Field of Classification Search

CPC ..... E02D 27/42

(Continued)

(56) References Cited

U.S. PATENT DOCUMENTS 646,970 A * 4/1900 Francis ..... E04H 12/2292 52/170
2,385,869 A * 10/1945 Lane ..... E02D 5/60 249/1

(Continued)

FOREIGN PATENT DOCUMENTS

| | | |
|---|---|---|
| EP | 0380884 A1 | 8/1990 |
| GB | 2323617 | 9/1998 |

(Continued)

OTHER PUBLICATIONS

International Searching Authority, "Invitation to pay additional fees," issued in connection with PCT application No. PCT/US2016/060949, dated Jan. 26, 2017, 7 pages.

(Continued)

*Primary Examiner* — Thomas B Will
*Assistant Examiner* — Katherine J Chu
(74) *Attorney, Agent, or Firm* — Hanley, Flight & Zimmerman, LLC

(57) ABSTRACT

A retractable bollard system for installation in a support surface that includes pavement includes a shell that when installed in the support surface extends below an upper surface of the pavement. The bollard system includes a post to be telescopically coupled to the shell. The post is axially movable relative to the shell selectively to an upper area and a lower area. The post extends farther above the shell when the post is in the upper area than when the post is in the lower area. The bollard system further includes a shock absorber to encircle the shell. The shock absorber is made of a polymeric material.

25 Claims, 32 Drawing Sheets

(58) Field of Classification Search
USPC ..... 404/6, 9, 10; 49/49, 131, 133; 52/169.13, 170
See application file for complete search history.

(56) References Cited

U.S. PATENT DOCUMENTS

| | | | | |
|---|---|---|---|---|
| 2,989,329 | A * | 6/1961 | Noah | A47B 9/20 148/188.5 |
| 3,660,935 | A | 5/1972 | Boots | |
| 3,698,135 | A | 10/1972 | Boots et al. | |
| 3,740,022 | A | 6/1973 | DiGiovanni | |
| 3,933,011 | A * | 1/1976 | DiGilio | A44C 17/0208 403/349 |
| 4,003,161 | A | 1/1977 | Collins | |
| 4,183,505 | A * | 1/1980 | Maestri | E01F 15/06 114/220 |
| 4,571,118 | A * | 2/1986 | Schmanski | E01F 9/629 116/63 R |
| 4,576,508 | A | 3/1986 | Dickinson | |
| 4,666,331 | A * | 5/1987 | Riley | E01F 13/046 256/1 |
| 4,715,742 | A | 12/1987 | Dickinson | |
| 4,919,563 | A | 4/1990 | Stice | |
| 5,054,237 | A | 10/1991 | Kapala et al. | |
| 5,365,694 | A | 11/1994 | Macaluso | |
| 5,425,595 | A * | 6/1995 | Roper | E01F 13/046 404/9 |
| 5,476,338 | A | 12/1995 | Alberts | |
| 5,566,927 | A | 10/1996 | Venegas, Jr. | |
| 5,597,262 | A * | 1/1997 | Beavers | E01F 9/627 116/63 P |
| 5,625,988 | A * | 5/1997 | Killick | E01F 9/685 248/156 |
| 5,755,431 | A | 5/1998 | Williams | |
| 6,098,353 | A * | 8/2000 | Stanfield | E01F 9/685 52/169.13 |
| 6,244,324 | B1 | 6/2001 | Quates et al. | |
| 6,345,930 | B1 | 2/2002 | Mohassel | |
| 6,494,636 | B1 * | 12/2002 | Mozena | A63C 11/221 403/109.2 |
| 6,648,162 | B1 * | 11/2003 | Wooderson | A47J 27/0813 220/203.27 |
| 6,821,050 | B1 * | 11/2004 | Maldonado | E01F 13/046 404/6 |
| 6,955,495 | B1 | 10/2005 | Datta et al. | |
| 6,971,329 | B1 * | 12/2005 | Stewart | E01F 13/028 116/63 C |
| 7,052,201 | B2 * | 5/2006 | Zivkovic | E01F 9/685 404/10 |
| 7,244,075 | B2 | 7/2007 | Stadler | |
| 7,261,051 | B2 * | 8/2007 | Tipaldo | E01F 9/688 116/63 P |
| 7,287,930 | B2 * | 10/2007 | Yamasaki | E01F 15/146 404/10 |
| 7,717,641 | B2 | 5/2010 | Stice | |
| 7,832,957 | B2 | 11/2010 | Gelfand | |
| 8,057,329 | B2 * | 11/2011 | Cusimano | A63B 61/02 473/490 |
| 8,096,725 | B2 | 1/2012 | Bedhome et al. | |
| 8,096,727 | B2 | 1/2012 | Parenti et al. | |
| 8,297,873 | B1 | 10/2012 | Schram et al. | |
| 8,579,540 | B2 | 11/2013 | Lafont | |
| 8,833,786 | B2 * | 9/2014 | Camp | B62J 1/08 280/281.1 |
| 8,966,837 | B2 * | 3/2015 | Knudsen | E02D 5/226 52/165 |
| 2005/0211389 | A1 | 9/2005 | Snyder et al. | |
| 2006/0204327 | A1 * | 9/2006 | Phelan | E01F 13/046 404/6 |
| 2009/0008042 | A1 | 1/2009 | Snyder et al. | |
| 2013/0192149 | A1 | 8/2013 | Roach | |
| 2013/0221301 | A1 | 8/2013 | Cowie et al. | |
| 2013/0287492 | A1 | 10/2013 | Miracle | |

FOREIGN PATENT DOCUMENTS

| | | |
|---|---|---|
| GB | 2392699 | 3/2004 |
| WO | 0026472 | 5/2000 |
| WO | 0212634 A2 | 2/2002 |
| WO | 2012131381 A2 | 10/2012 |
| WO | 2012164275 A1 | 12/2012 |
| WO | 2013081474 A1 | 6/2013 |

OTHER PUBLICATIONS

Fadini, "GASPO 252 Retractable manual traffic control posts", retrieved from the web site http://www.fadini.net/prodotto.asp?language=ENG&id=37, last visited Nov. 11, 2015, 3 pages.

Fadini, "GASPO 252 Manual Post with Gas Springs", Drawing. No. 6448, Sep. 14, 1 page.

International Searching Authority, "International Search Report and Written Opinion," issued in connection with PCT Application No. PCT/US2016/060949, dated Apr. 19, 2017, 23 pages.

* cited by examiner

SHOCK ABSORBING RETRACTABLE BOLLARD SYSTEMS

FIELD OF THE DISCLOSURE

This patent generally pertains to bollards and more specifically to shock absorbing retractable bollard systems.

BACKGROUND

Retractable bollards have posts that can be raised for blocking vehicular traffic or lowered flush to the floor to allow traffic to pass. Retractable bollards can be used on roadways, driveways, loading docks, rail or finger docks, factories, and warehouse floors. Examples of retractable bollards are disclosed in U.S. Pat. Nos. 8,096,727; 6,955,495; 6,345,930; 5,476,338; 5,365,694; 5,054,237; 4,919,563; 4,715,742; 4,576,508; 4,003,161; 3,698,135; and 3,660,935. Each of the bollards described in these patents has one or more limitations such as complexity, manufacturing cost, durability, replaceability, and/or single purpose functionality.

DETAILED DESCRIPTION

Figure 1:
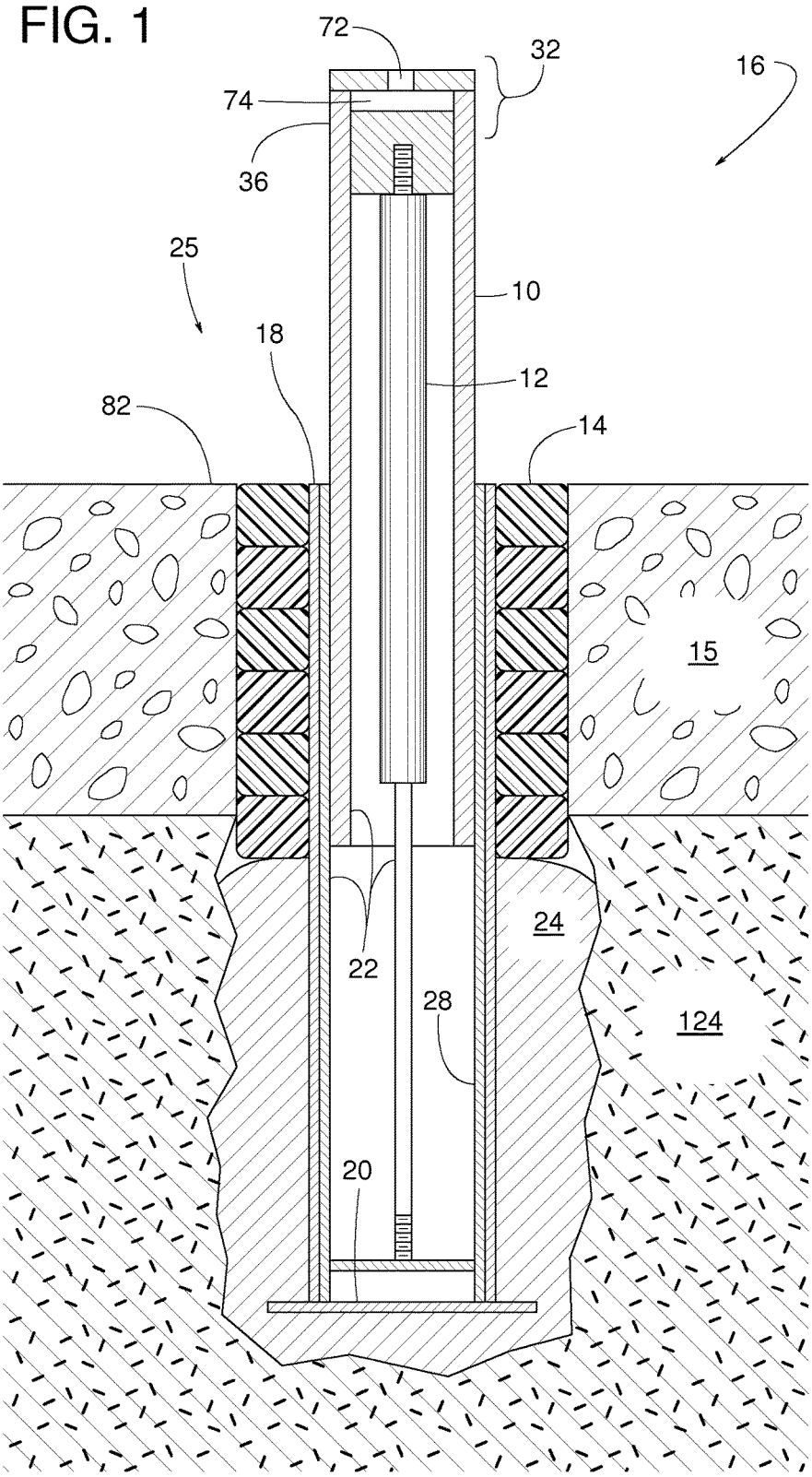
FIG. 1 is a cross-sectional view of an example retractable bollard system constructed in accordance with the teachings disclosed herein.

FIGS. 1-46 show various example bollard systems having a retractable post 10 that can be manually raised for blocking vehicular or pedestrian traffic as needed or retracted flush to floor level to allow traffic to pass. Posts (such as the example post 10) can be used either alone or in combination with some type of add-on barrier or handrail. Some of the example bollard systems include an internal spring 12 (e.g., a gas pressurized strut) for easing the effort of manually extending or retracting the post 10. In some examples, in the event of a vehicle accidentally striking an elevated post, a shock absorber 14 helps prevent damaging the bollard and/or the surrounding pavement. In some examples, if a bollard needs to be replaced, it can simply be pulled out from within a receptacle permanently embedded in the pavement, and a drop-in replacement bollard can be installed without tools. Some of the example bollard systems are modular and versatile with six or more unique configurations.

FIGS. 1-12 show an example retractable bollard system 16 installed at a chosen area 25 that includes a layer of pavement 15 overlying ground material 124. The term, "pavement" refers to any surface installed and prepared for handling wheeled or pedestrian traffic. Examples of pavement 15 include concrete, asphalt, coatings, and various combinations thereof. The term, "ground material" refers to an earth aggregate such as dirt, sand, clay, gravel, etc. The term, "pavement overlying ground material" means that the pavement 15 is on top of the ground material 124, either directly on top of it or with some intermediate material sandwiched between the pavement 15 and the ground material 124.

Figure 6:
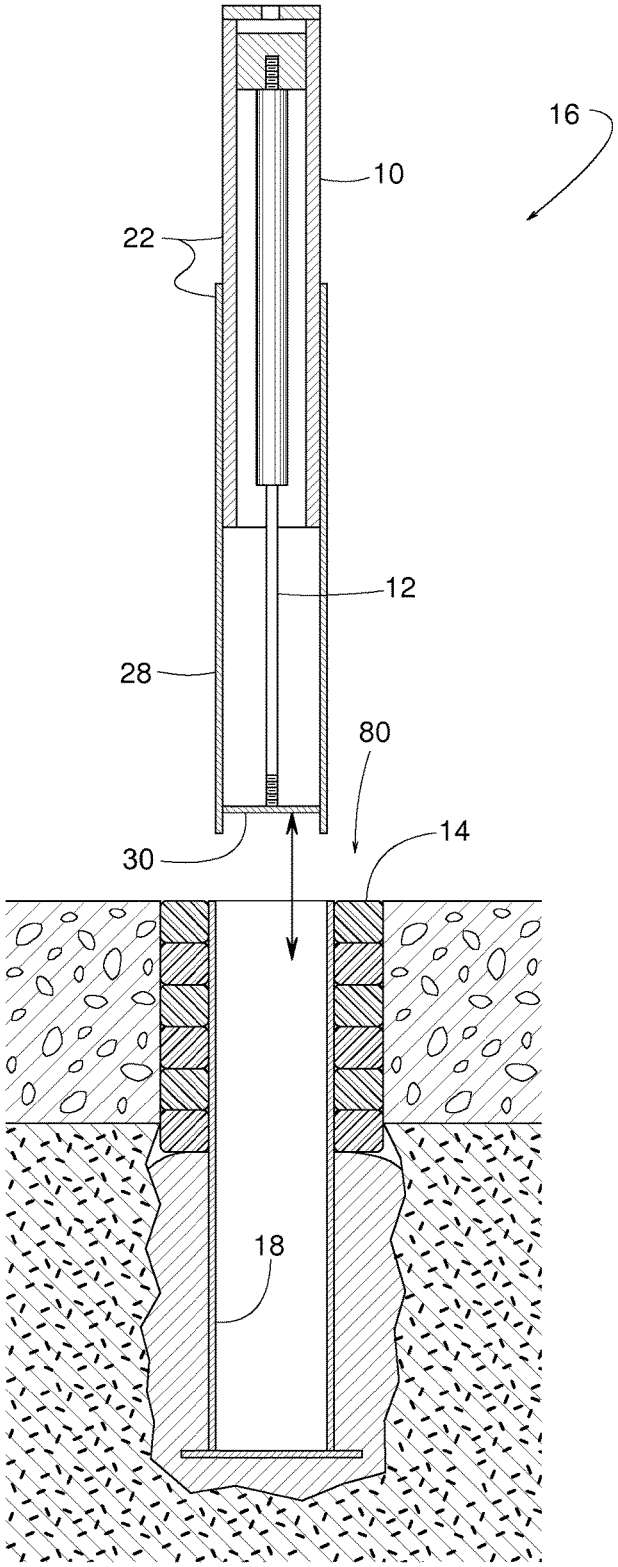
FIG. 6 is a cross-sectional assembly view similar to FIG. 1 but showing the selective installation and removal of an example bollard.

As shown in FIGS. 1-12, some examples of the bollard system 16 comprise a ground sleeve 18 with an attached anchor plate 20, a retractable bollard 22 installed within the ground sleeve 18, and the shock absorber 14. In some examples, cement 24 anchors a lower portion of the ground sleeve 18 in place to provide a relatively permanent receptacle below ground level. The term, "cement" refers to any relatively thick bonding material, examples of which include concrete, mortar, grout, and epoxy. In the illustrated example, a sliding fit 26 between the bollard 22 and the ground sleeve 18 allows the bollard 22 to be readily inserted and removed without tools and without having to disturb the ground sleeve 18, as shown in FIG. 6. Some examples of the ground sleeve 18 and/or the bollard 22 include drain holes that allow incidental accumulations of water to escape.

In the illustrated example, the bollard 22 comprises the post 10, the spring 12, and a tubular shell 28 with an attached bottom plate 30. In some examples, the post 10 telescopically fits within the shell 28 and is movable relative to the shell 28 in an axial direction such that the post 10 can selectively extend to an upper area 32 (FIGS. 1, 2, 9 and 10) and retract to a lower area 34 (e.g., FIGS. 4, 5, 7 and 8). In some examples, the spring 12 urges the bollard 22 to extend and raise the post 10 toward the upper area 32.

The term, "spring" broadly refers to any member or assembly extendible between a first position (e.g., FIG. 5) and a second position (e.g., FIG. 2), wherein the member or assembly stores more energy in the first position than in the second position, and the member or assembly urges itself to the second position. Examples of a spring include a helical coil, a compression spring, a tension spring, a gas spring, a pneumatic spring, a gas pressurized strut, etc. In the illustrated example, the spring 12 is a gas pressurized strut that urges the bollard 22 to extend vertically by the spring 12 bracing itself against the bottom plate 30 and pushing a head 36 of the post 10 upward. In some examples, the spring 12 is a SUSPA C16-18862 provided by SUSPA Inc. of Grand Rapids, Mich. and distributed by McMaster-Carr as part number 9416K22.

To limit the axial extension of the bollard 22 and to help hold the post 10 at either an extended or a retracted position, some examples of the bollard 22 include a guide follower 38 that travels in a path of movement 40 along a guide surface 42, as shown in FIGS. 7-10. The term, "guide surface" refers to any structure that directs the movement of a member traveling along the structure. The term, "guide follower" refers to any member having a travel direction that is directed by a guide surface. In the illustrated example, the guide surface 42 is provided by a slot 44 in the shell 28, and the guide follower 38 is a pin fixed to the post 10 and protruding radially outward from an outer diameter of the post 10 into the slot 44. In other examples, the guide surface 42 is provided the slot in the post 10 while the guide follower 38 is fixed to the shell 28 and protrudes radially inward from an inner diameter of the shell 28.

In the example shown in FIGS. 7-10, the guide surface 42 of the slot 44 includes an upper offset 46 connecting a vertically elongate section 48 to an upper end stop 50 and also includes a lower offset 52 connecting the vertically elongate section 48 to a lower end stop 54. One example operation of the bollard 22 follows FIGS. 7-10 sequentially.

Figure 7:
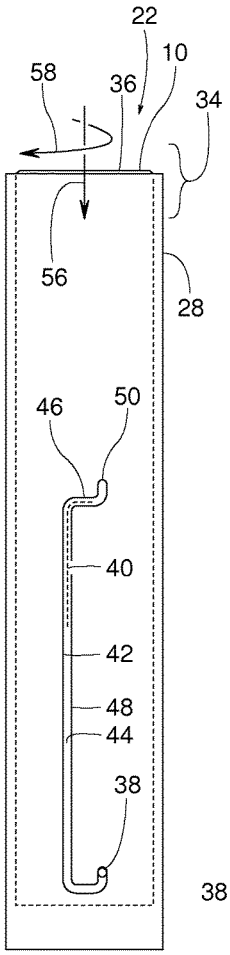
FIG. 7 is a side view of the example bollard shown in FIGS. 1-6, wherein an example post of the example bollard is in a lower area and a stored position.

In the configuration shown in FIG. 7, the spring 12 urges the post 10 upward such that the pin 38 presses upward against the lower end stop 54. With the head 36 of the post 10 at the lower area 34 with the post 10 being in a stored position (FIG. 7), the pin 38 engages the lower end stop 54 to hold the post 10 in the retracted stored position. In the illustrated example, the post 10 can be released and extended by first pushing the post 10 downward to move the pin 38 away from the lower end stop 54, as indicated by arrow 56. The post 10 is then rotated, as indicated by arrow 58, to move the pin 38 along the lower offset 52 until the pin 38 reaches the lower end of the vertically elongate section 48, whereby the post 10 is now in the released position, as shown in FIG. 8.

Figure 8:
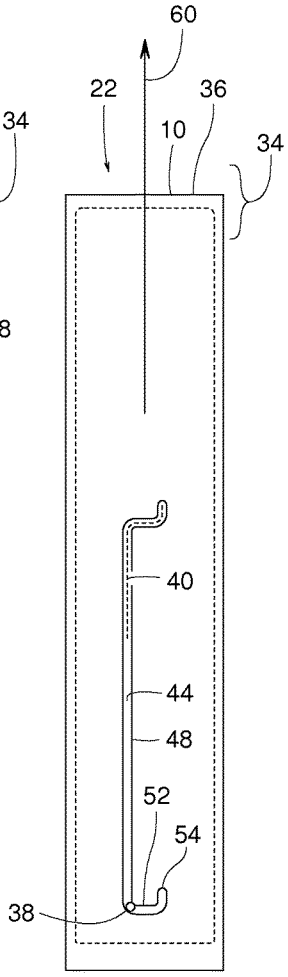
FIG. 8 is a side view of the example bollard shown in FIGS. 1-6, wherein the example post of the example bollard is in a lower area and a released position.
Figure 9:
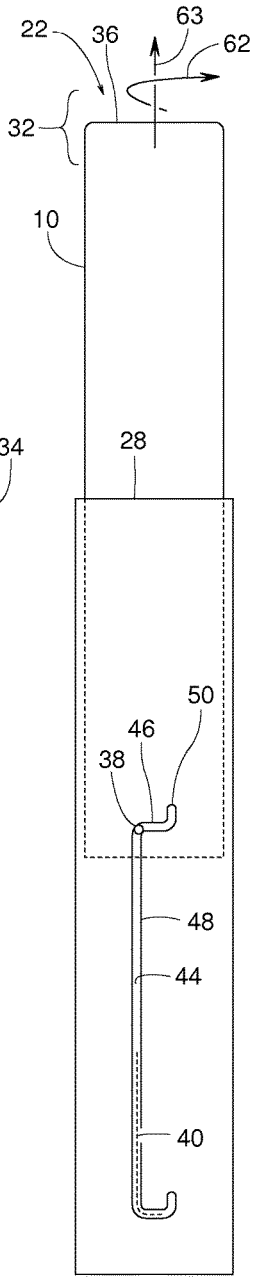
FIG. 9 is a side view of the example bollard shown in FIGS. 1-6, wherein the example post of the example bollard is in an upper area and an unlocked position.
Figure 10:
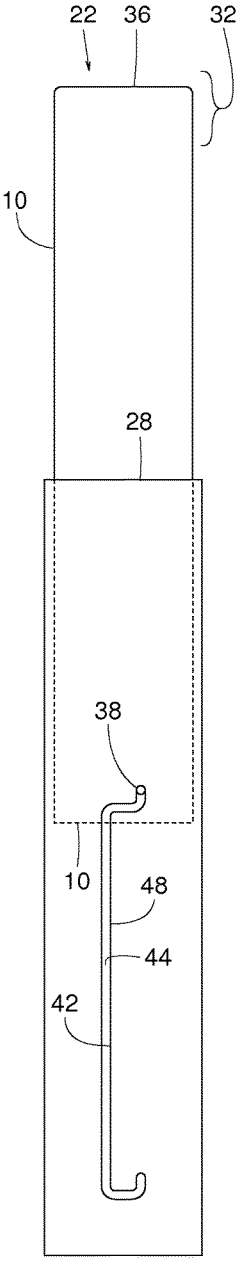
FIG. 10 is a side view of the example bollard shown in FIGS. 1-6, wherein the example post of the example bollard is in an upper area and a locked position.

From the configuration shown in FIG. 8, the spring 12 pushes the post 10 up (as indicated by arrow 60) along the vertically elongate section 48 to the pin position shown in FIG. 9. The illustrated example of FIG. 9 shows the head 36 of the post 10 in the upper area 32 with the post 10 being in the unlocked position. While in the upper area 32, to move the post 10 from the unlocked position (FIG. 9) to the locked position (FIG. 10), the post 10 is rotated as indicated by arrow 62 of FIG. 9. In the illustrated example, the rotation 62 moves the pin 38 from the vertically elongate section 48 through the upper offset 46. The spring 12 then lifts the post 10 (as indicated by arrow 63) until the pin 38 reaches the upper end stop 50, as shown in FIG. 10. At this point, as shown in FIG. 10, the post 10 is in the upper area 32 with the post 10 being in the locked position. Thus, the spring 12 urging the pin 38 up against the upper end stop 50 holds the post 10 in its fully extended position, and the spring 12 urging the pin 38 up against the lower end stop 54 holds the post 10 in its retracted stored position.

Figure 2:
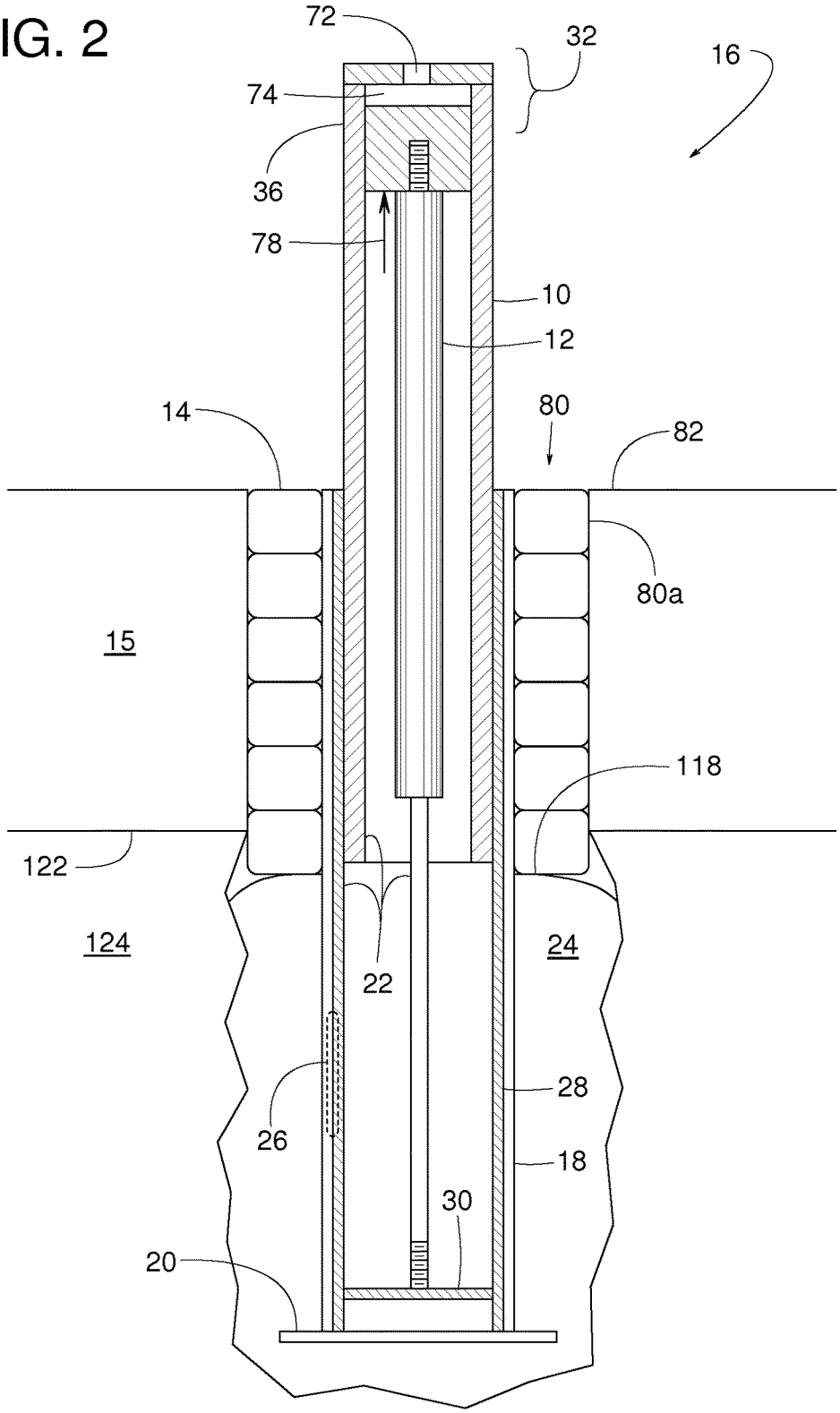
FIG. 2 is a cross-section view similar to FIG. 1 but with some of the cross-hatching omitted.
Figure 3:
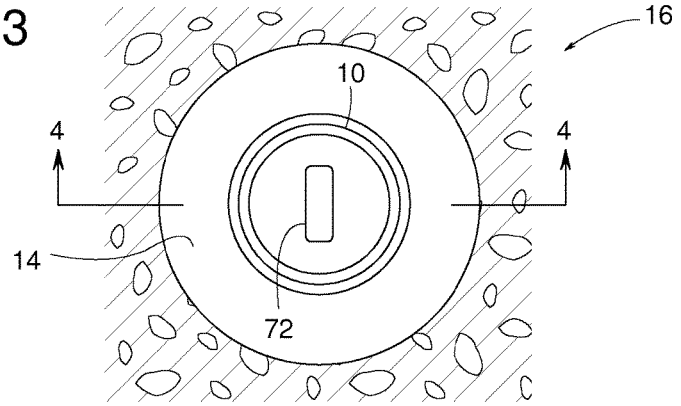
FIG. 3 is a top view of the example retractable bollard system shown in FIGS. 1 and 2.
Figure 4:
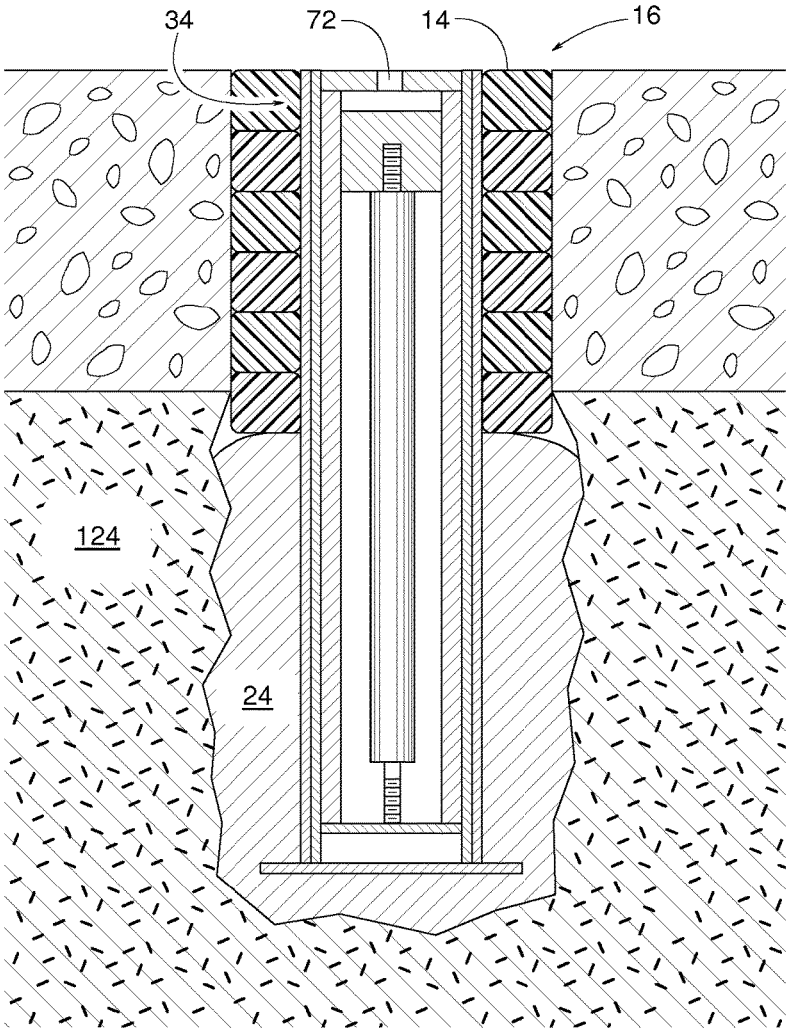
FIG. 4 is a cross-sectional view taken along line 4-4 of FIG. 3.
Figure 5:
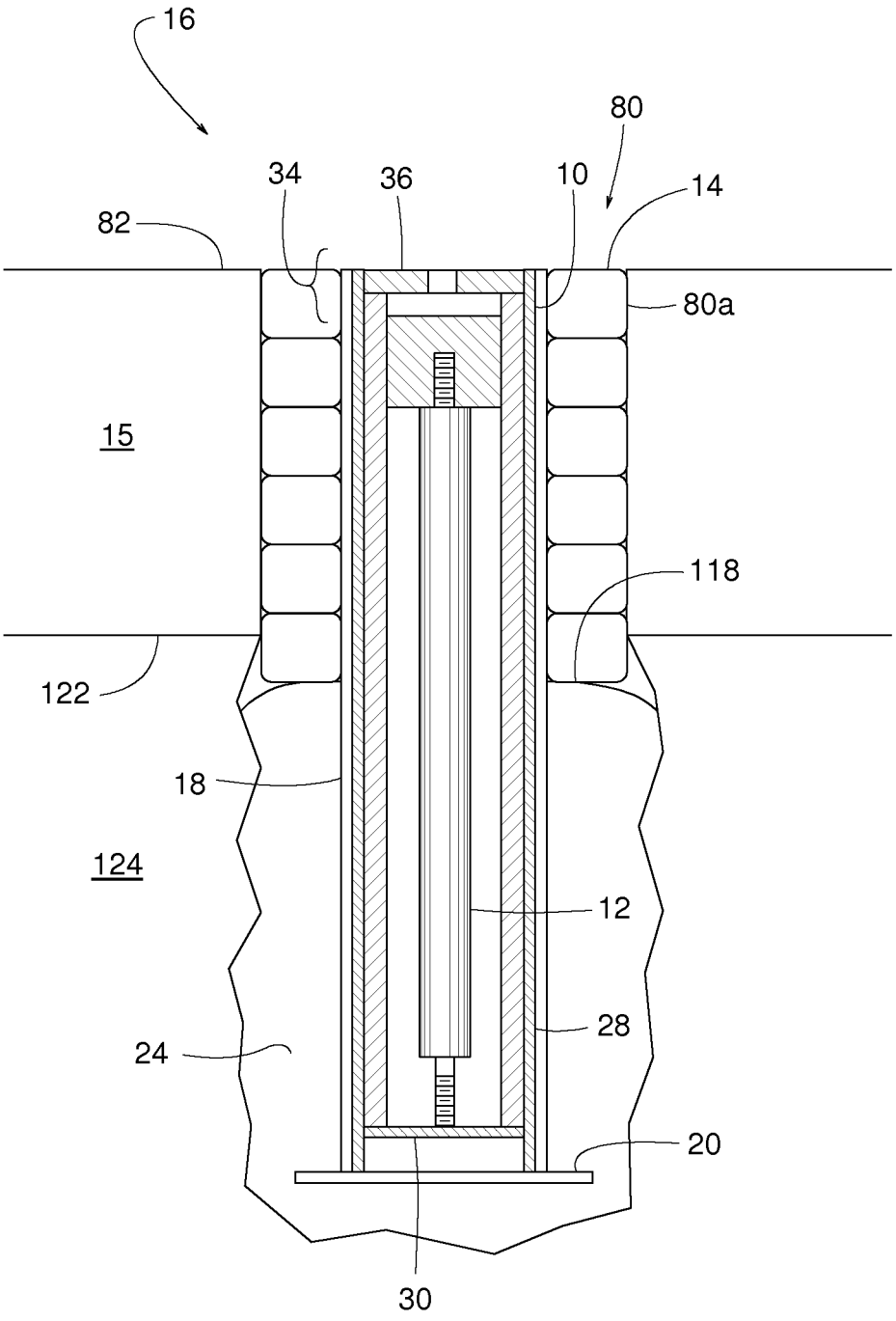
FIG. 5 is a cross-sectional view similar to FIG. 4 but with some of the cross-hatching omitted.
Figure 11:
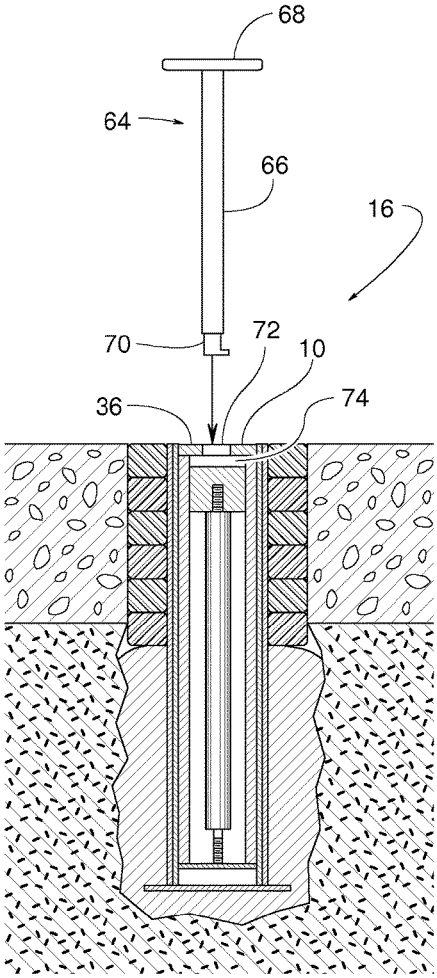
FIG. 11 is a cross-sectional view similar to FIG. 4 showing an example tool in a disengaged position, wherein the tool is constructed in accordance with the teachings disclosed herein.
Figure 12:
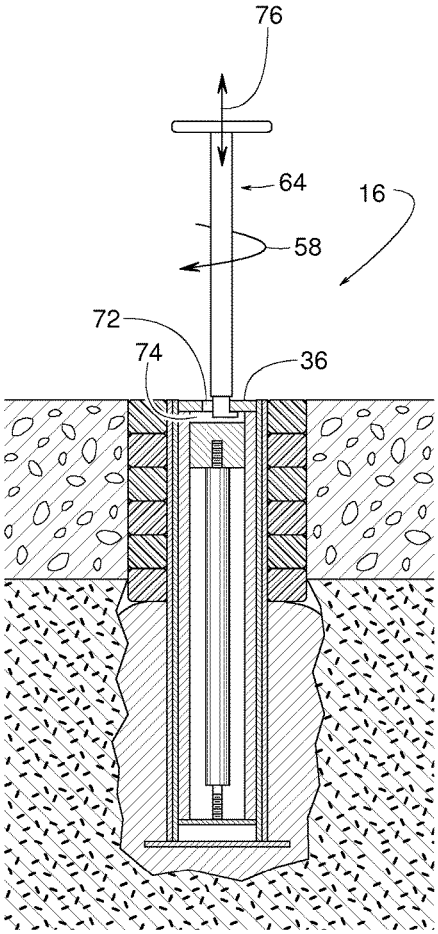
FIG. 12 is a cross-sectional view similar to FIG. 12 but showing the tool in an engaged position.

In some examples, as shown in FIGS. 11 and 12, a manually operated tool 64 can be used to help move the post 10 between its stored position (FIGS. 4, 5, 7, 11 and 12) and its extended position (FIGS. 1, 2 and 10). In the illustrated example, the tool 64 comprises a shank 66 extending between a handle 68 and an extremity 70. In some examples, the extremity 70 fits through a slot 72 in the head 36 of the post 10 and can extend into a cavity 74 in the head 36. In some examples, the extremity 70 and the slot 72 are shaped to enable the tool 64 to both rotate the post 10 (as indicated by arrows 58, and 62) and to assist in moving the post 10 vertically (as indicated by arrows 56, 60, 64 and 76). In some examples, the tool's weight, the post's weight, and/or a force 78 (FIG. 2) exerted by the spring 12 are strategically chosen to assist in the lifting or lowering of the post 10. In some examples, the spring's lifting force 78 is greater than the sum of the post's weight and the tool's weight. For instance, in some examples, the lifting force 78 of the spring 12 is about 50 lbs., the weight of the post 10 is about 22 lbs., and the weight of the tool 64 is about 3 lbs.

When the bollard 22 is fully extended, the shock absorber 14 helps cushion the impact of a vehicle accidentally striking the post 10. To protect the bollard 22, some examples of the shock absorber 14 are of a material that is softer than the ground sleeve 18, the shell 28 and the post 10. Some example materials of the shock absorber 14 include polyurethane, polypropylene, natural rubber, synthetic rubber (e.g., Buna-N rubber), and various combinations thereof, etc.

Figure 13:
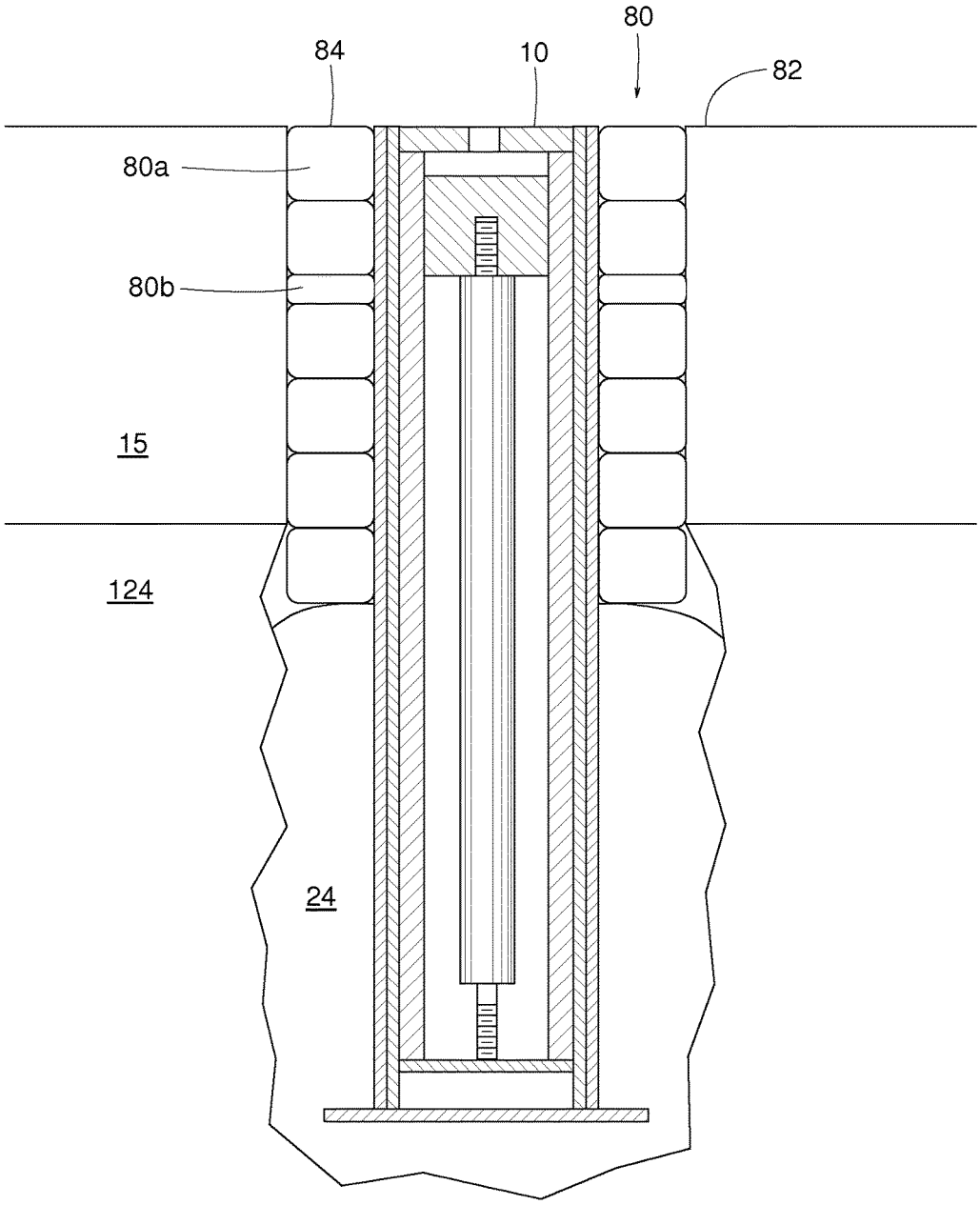
FIG. 13 is a cross-sectional view similar to FIG. 5 but showing another example retractable bollard system constructed in accordance with the teachings disclosed herein.

In the example illustrated in FIGS. 1-6, the shock absorber 14 comprises a plurality of vertically stacked polymeric rings 80 (e.g., ring 80*a* and 80*b*) encircling the ground sleeve 18, the shell 28 and the post 10. In some examples, one or more of the rings 80 include relief cuts or notches around their outer diameter to create voids into which the material of the rings 80 may flow during compression (e.g., during an impact). In some examples, one or more rings 80 are softer than other rings of the same stack. For instance, in some examples, the uppermost ring 80*a* is softer than the ones below it to reduce the horizontal force that a struck post 10 might otherwise exert sideways against or near an upper surface 82 of the pavement 15, which might tend to crack more readily than deeper areas of the pavement 15. In some examples, the hardness of the rings 80 corresponds to between a 95 Shore A durometer and a 60 Shore D durometer. In some examples, the hardness of the rings 80 approximately corresponds to a 45 Shore D durometer. In some examples, as shown in FIG. 13, one or more rings 80*b* are thinner than other rings of the same stack to ensure that a top 84 of the stack of rings 80 lies generally flush with the pavement's adjacent upper surface 82. In some examples, the axial thickness of the rings 80 is approximately 1.5 inches (e.g., 1 inch, 1.25 inches, 1.5 inches, 2 inches) with a radial width of approximately 1 inch (e.g., 0.5 inches, 0.75 inches, 1 inch, 1.5 inches). In some examples, the shock absorber 14 extends to a depth of at least 7.5 inches below the upper surface 82 (e.g., at least 5 rings each 1.5 inches thick). In some examples, metal stiffeners (e.g., made of steel, aluminum, etc.) with radially extending flanges along the circumference (e.g., similar to teeth on a gear or sprocket) are placed between adjacent ones of the rings 80 with the flanges extending to the outer diameter of the rings 80. In some such examples, the stiffeners increase the energy absorption of the system by the flanges bending in response to an impact with the bollard 22, thereby reducing the damage to the rings 80.

Figure 14:
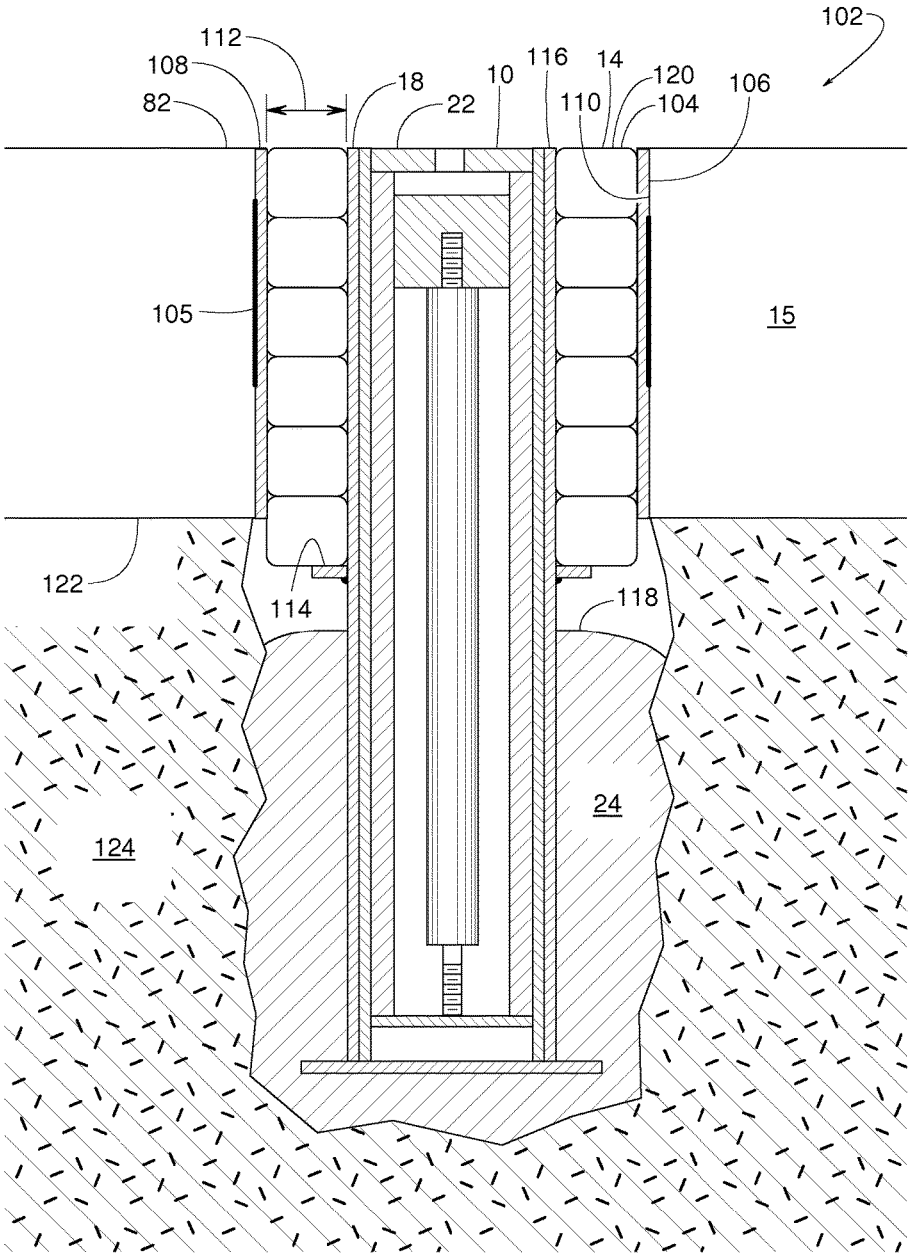
FIG. 14 is a cross-sectional view similar to FIG. 4 but showing another example bollard system constructed in accordance with the teachings disclosed herein.

FIG. 14 shows an example retractable bollard system 102 with means for reinforcing at least an upper circular edge 104 of the pavement 15 and means for ensuring that the shock absorber 14 is installed substantially flush (e.g., within ¼ inch) with the pavement's upper surface 82. In the illustrated example, an adhesive 105 bonds an outer perimeter 106 of a metal tubular liner 108 to an inner bore 110 of the pavement 15. The term, "adhesive" refers to any material (e.g., cement) that helps bond one surface to another. The adhesive 105 can be of any material thickness. In some examples, the adhesive 105 is about one inch thick. In the illustrated example, bonding the liner 108 to the pavement 15 reinforces the bore 110 and creates an annular gap 112 between the liner 108 and the ground sleeve 18. In some examples, the shock absorber 14 is installed within the annular gap 112.

In the illustrated example, to ensure the top of the shock absorber 14 is installed substantially flush with the pavement's upper surface 82, a shoulder 114 is disposed on the ground sleeve 18 at a precise axial location that establishes a proper vertical distance from the shoulder 114 to an upper edge 116 of the ground sleeve 18. The term, "shoulder" as it pertains to a retractable bollard refers to any ledge able to engage and support a shock absorber protecting the bollard. Examples of such a shoulder include a flange, a radial protrusion, a radial protruding pin, a ring, and a groove with an upward facing surface. In the illustrated example, the shoulder 114 eliminates the need to anchor the ground sleeve 18 with a precise volume of the cement 24, as an upper surface 118 of the cement 24 would not be relied upon to establish the location of the shock absorber's top surface 120.

In other examples, however, without the shoulder 114, the shock absorber 14 is stacked directly on top of the cement 24, as shown in FIGS. 1, 2, 4 and 5. In either case, with or without the shoulder 114, having the cement 24 and/or the shoulder 114 below a bottom surface 122 of the pavement 15 provides the bollard 22 with more freedom to move radially in reaction to an impact because the ground material 124 is more giving than the pavement 15. So, in the illustrated examples, the shock absorber 14 extends below the pavement's bottom surface 122.

Figure 15:
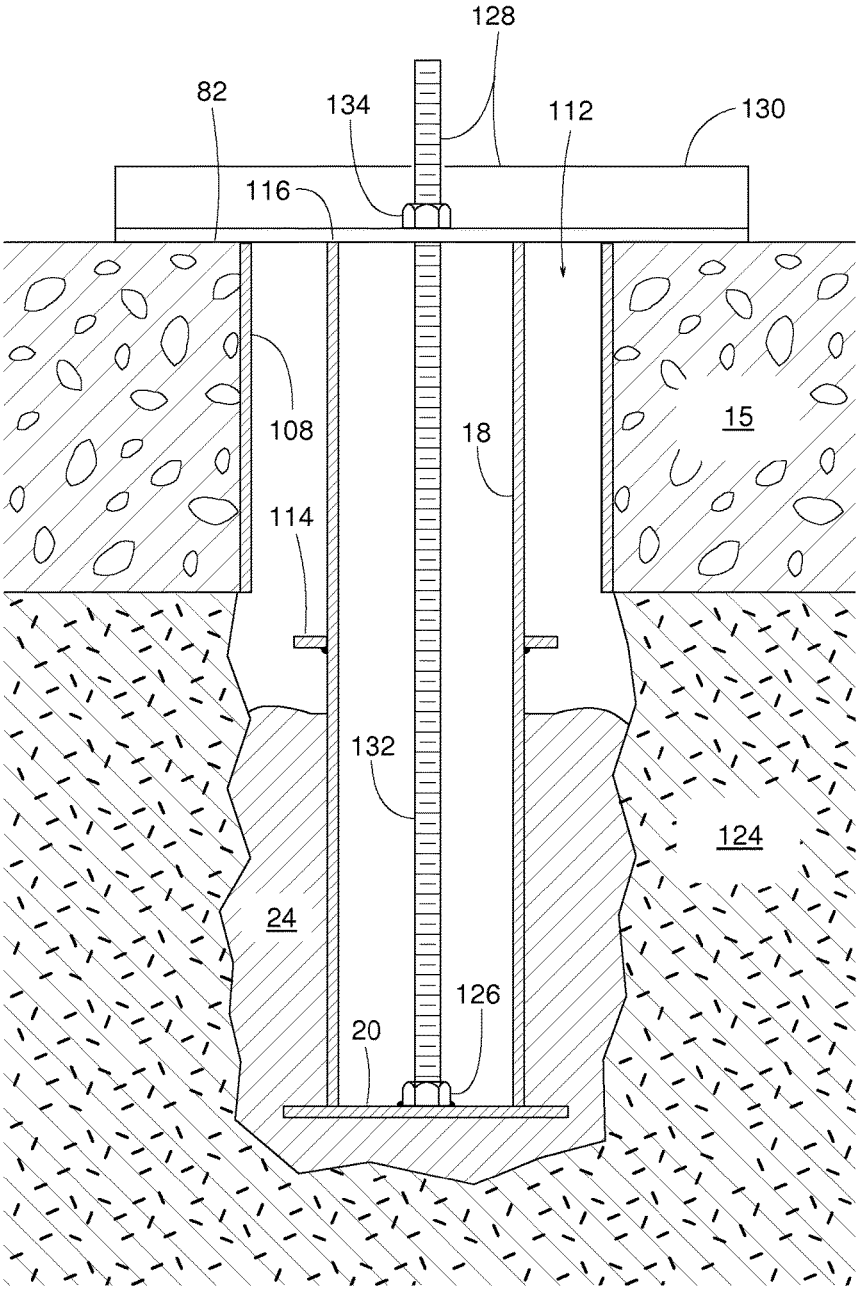
FIG. 15 is a cross-sectional view similar to FIG. 14 but showing an example installation method of a partially completed example retractable bollard system constructed in accordance with the teachings disclosed herein.
Figure 16:
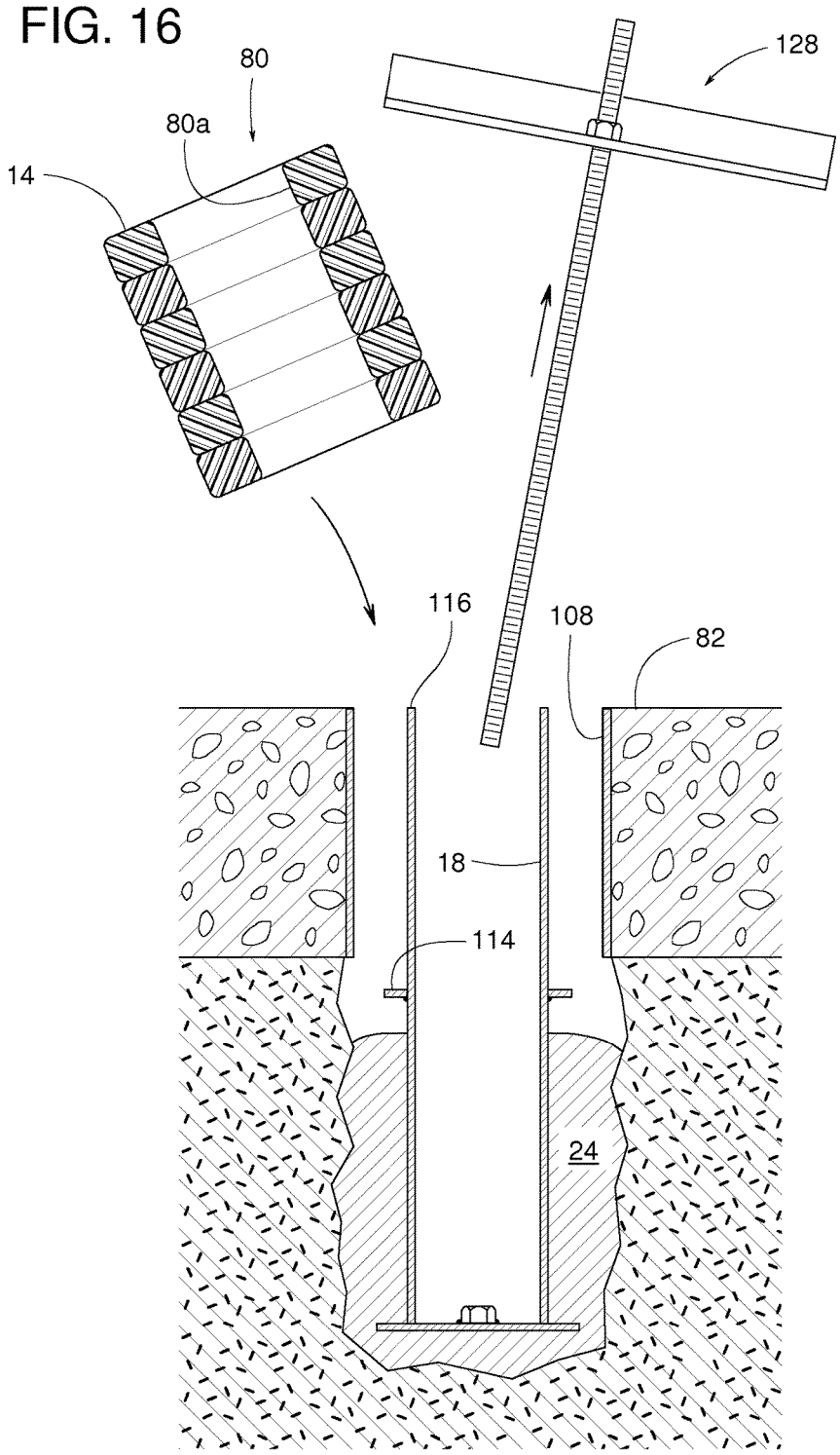
FIG. 16 is a cross-sectional view similar to FIG. 15 but further illustrating the example installation method.
Figure 17:
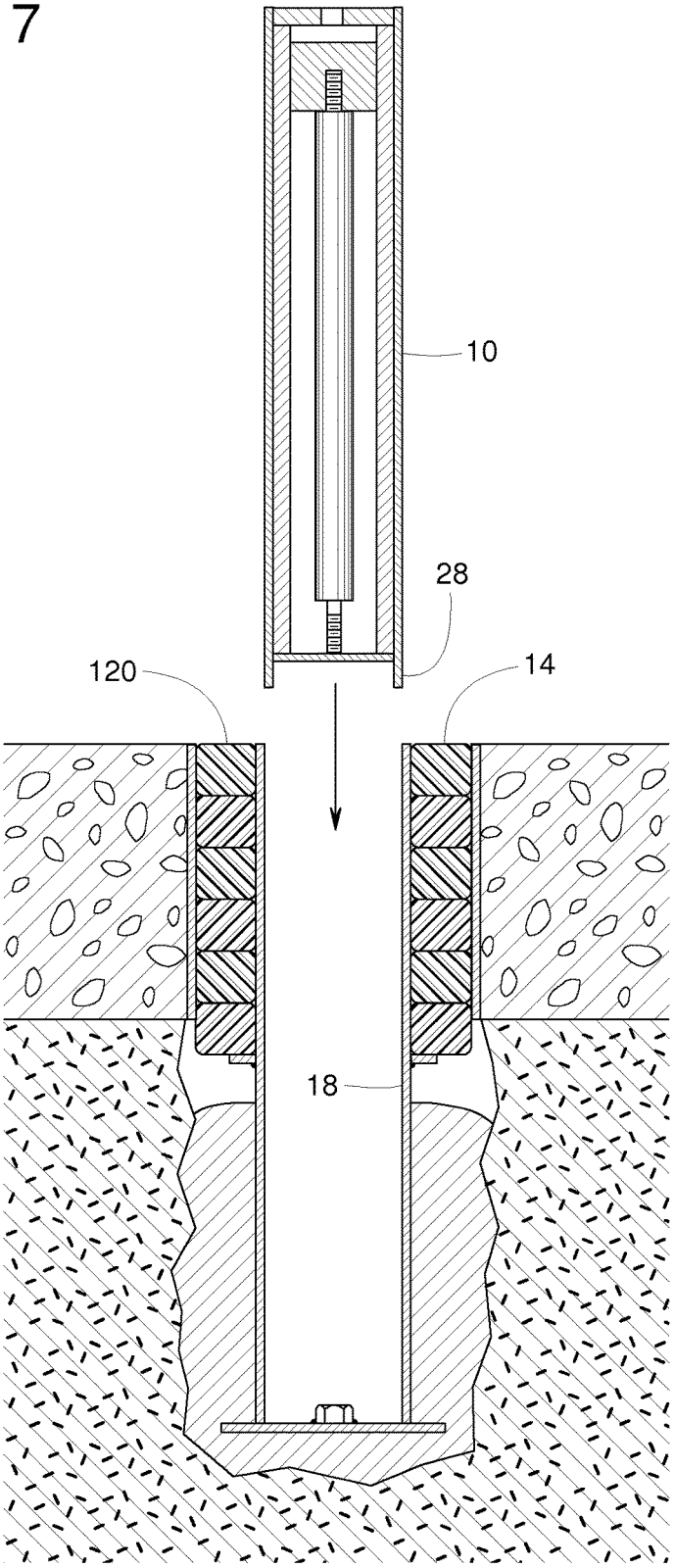
FIG. 17 is a cross-sectional view similar to FIGS. 15 and 16 but further illustrating the example installation method.
Figure 18:
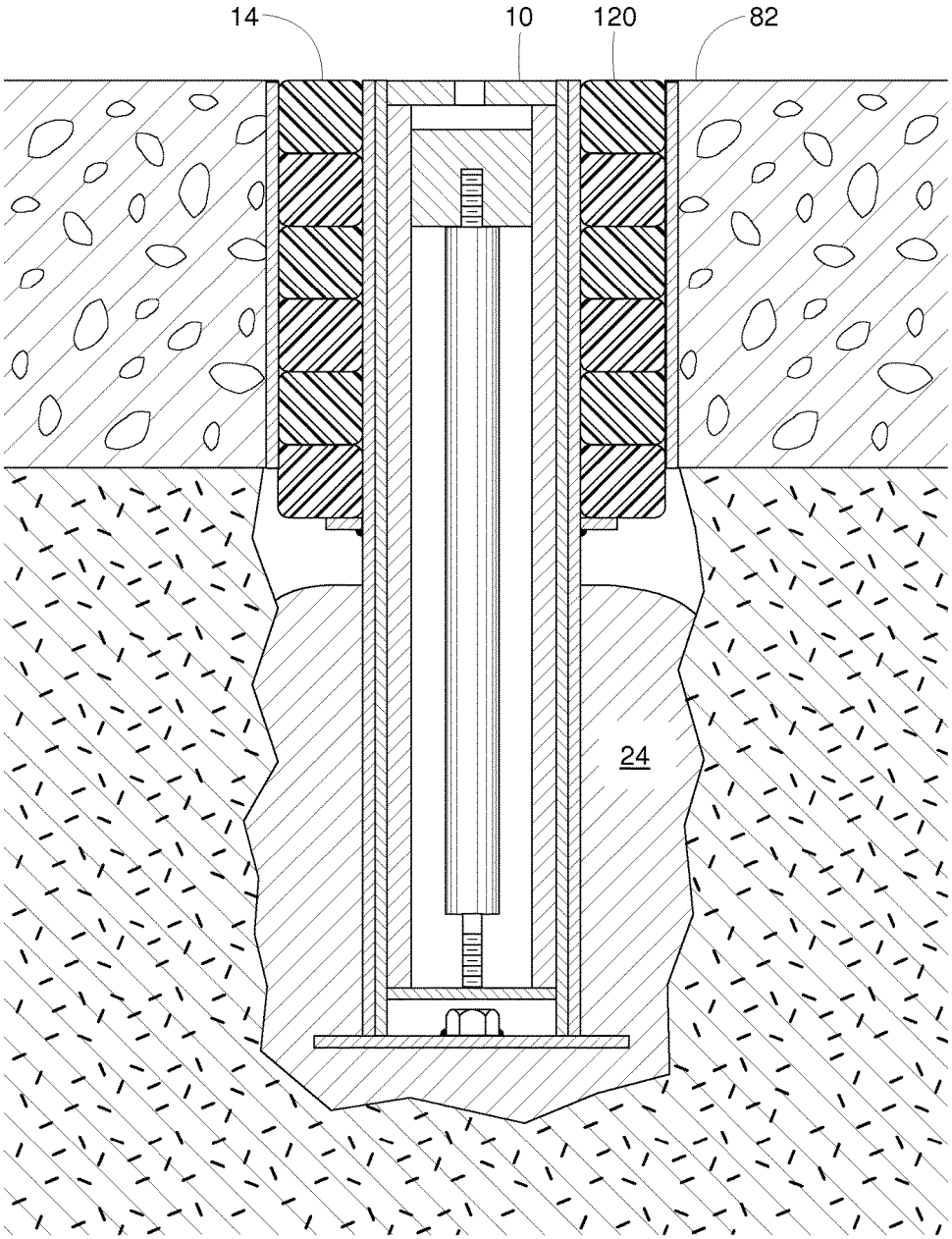
FIG. 18 is a cross-sectional view similar to FIGS. 4, 13 and 14 but showing the completed assembly of the example retractable bollard system of FIGS. 15-17.

FIGS. 15-18 illustrate one example method of installing the bollard 22. This example method involves the use of a threaded nut 126 welded to the anchor plate 20 and a fixture 128 comprising an angle iron 130, a threaded rod 132 and an upper nut 134. FIG. 15 shows the threaded rod 132 extending through the angle iron 130 and screwed into the nut 126. In some examples, the upper nut 134 is tightened to bring the upper edge 116 of the ground sleeve 18 flush with the pavement's upper surface 82. Cement 24 fills the gap between the ground sleeve 18 and the surrounding ground material 124. In the illustrated example, after the cement 24 hardens, the fixture 128 is removed and the shock absorber 14 is installed, as shown in FIG. 16. Next, in the illustrated example, the bollard 22 is inserted into the ground sleeve 18, as shown in FIG. 17. FIG. 18 shows the completed assembly.

Figure 19:
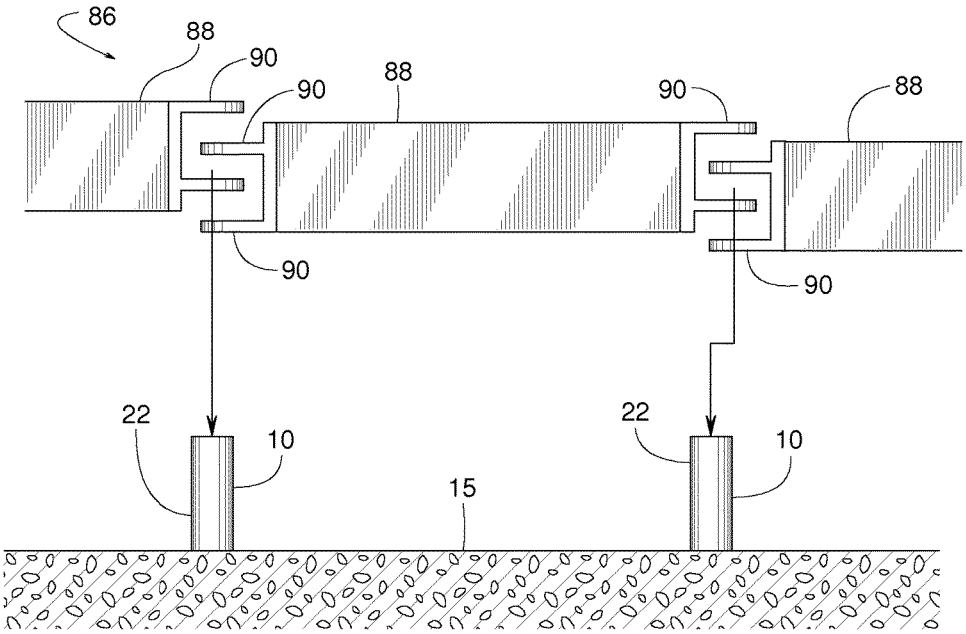
FIG. 19 is a side exploded view showing another example retractable bollard system constructed in accordance with the teachings disclosed herein.
Figure 20:
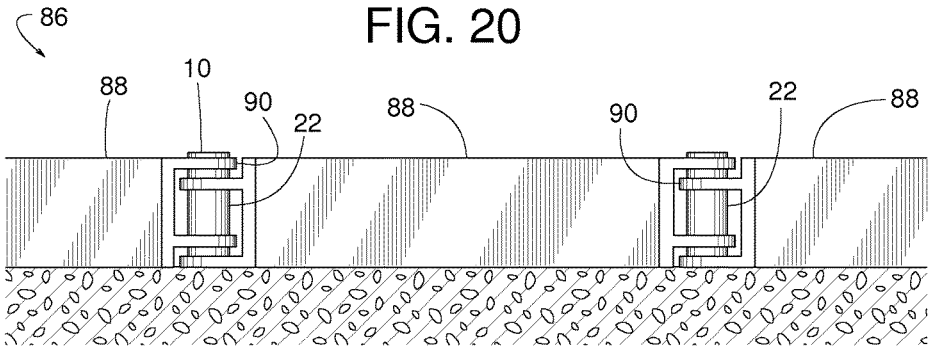
FIG. 20 is a side view similar to FIG. 19 but showing the retractable bollard system in an assembled configuration.

Although the example bollards 22 of the illustrated examples can be used alone, as shown in FIGS. 1-5, the bollards 22 can also be used in combination with some type of add-on barrier or handrail, which can provide a desired obstruction to traffic between spaced apart posts 10. FIGS. 19 and 20, for instance, show a retractable bollard system 86 comprising one or more barriers 88 coupled to and extending between two bollards 22. In this example, each barrier 88 is in the form of a horizontal beam with one or more rings 90 that are sized to slip over the posts 10, as shown in FIG. 20. In some examples, the elevation of the rings 90 are staggered to permit the installation of a plurality of the barriers 88 strung along a series of the posts 10.

Figure 21:
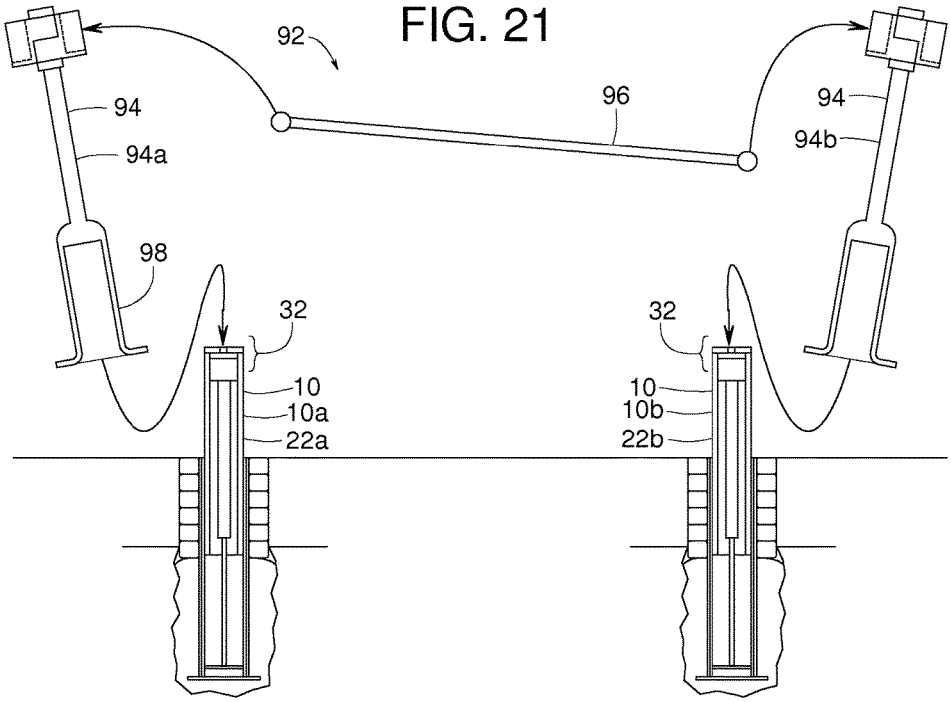
FIG. 21 is a side exploded view showing another example retractable bollard system constructed in accordance with the teachings disclosed herein.
Figure 22:
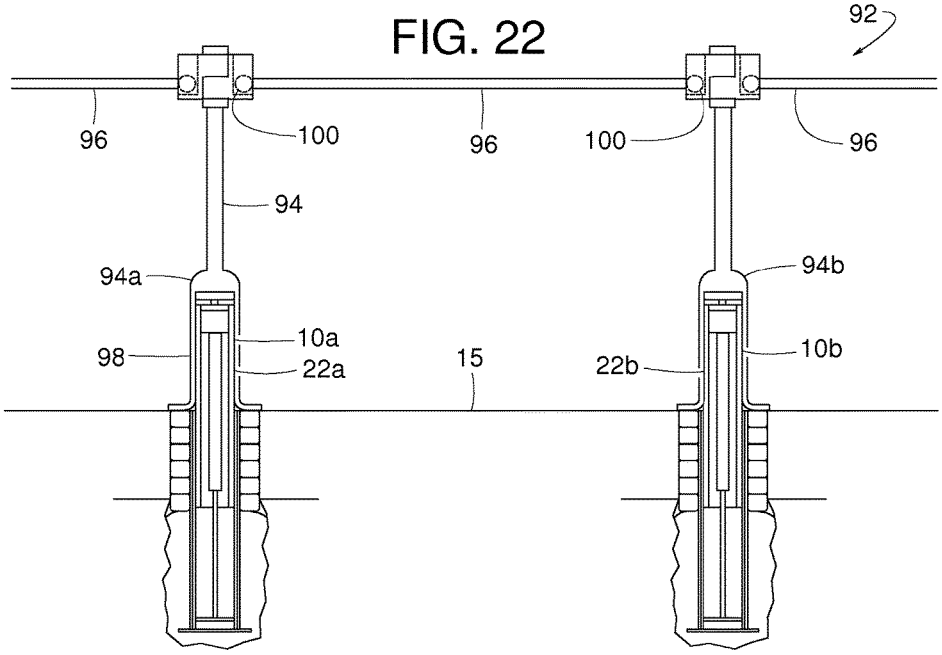
FIG. 22 is a side view similar to FIG. 21 but showing the retractable bollard system in an assembled configuration.

In another example illustrated in FIGS. 21 and 22, a retractable barrier system 92 includes at least two bollards 22, namely a first bollard 22*a* with a first retractable post 10*a*, and a second bollard 22*b* with a second retractable post 10*b*. The example retractable barrier system 92 further comprises two post extensions 94 (i.e., a first post extension 94*a* and a second post extension 94*b*). In some examples, the barrier system 92 also includes a handrail 96 extending between the post extensions 94*a*, 94*b*. When the post extensions 94 and the handrail 96 are installed, the handrail 96 is elevated and spaced apart from the pavement 15, as shown in FIG. 22.

In some examples, to install the post extensions 94, the posts 10*a*, 10*b* are extended to their respective upper areas 32, and an inverted cup 98 of each post extension 94 slidingly fits over a corresponding post 10. For durability and impact resistance, some examples of the inverted cup 98 comprise a flexible, shock absorbing polymeric material (e.g., polyurethane, other plastics, natural rubber, synthetic rubber, and various combinations thereof). In some examples, when the post extensions 94 are not in use, the posts 10 can be retracted, and the post extensions 94 and the handrail 96 can be removed and stored elsewhere. The illustrated example of FIG. 21 shows each post extension 94 in a removed position spaced apart from the posts 10, and FIG. 22 shows each of the post extensions 94 in an attached position coupled to the posts 10. In some examples, a ball-and-socket joint 100 or other suitable coupling connects the ends of the handrail 96 to the post extensions 94.

Figure 26:
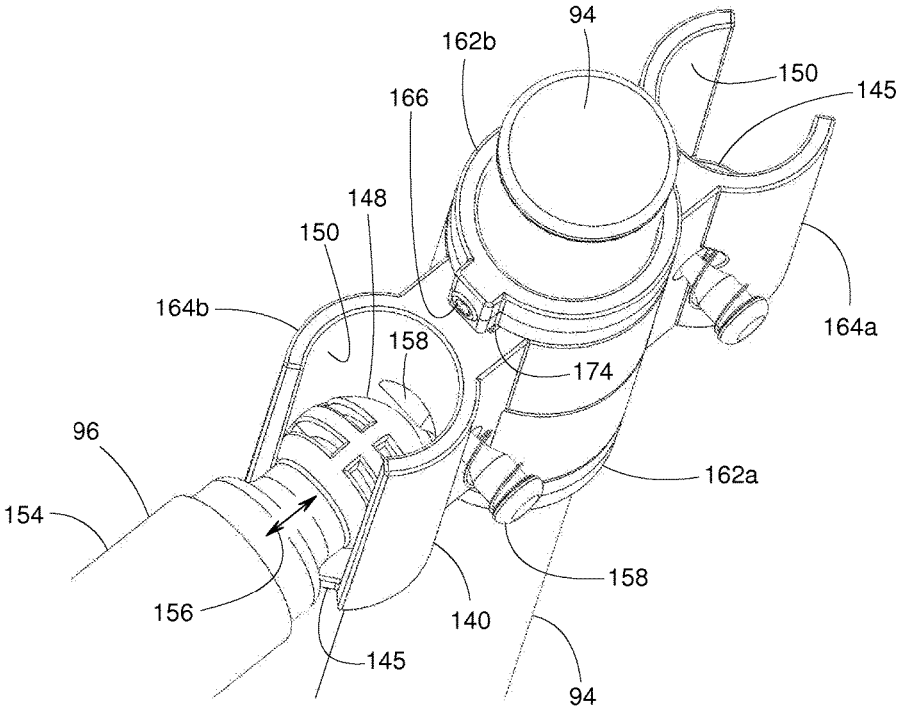
FIG. 26 is a perspective view of an example handrail connector also shown in FIGS. 23 and 24.
Figure 27:
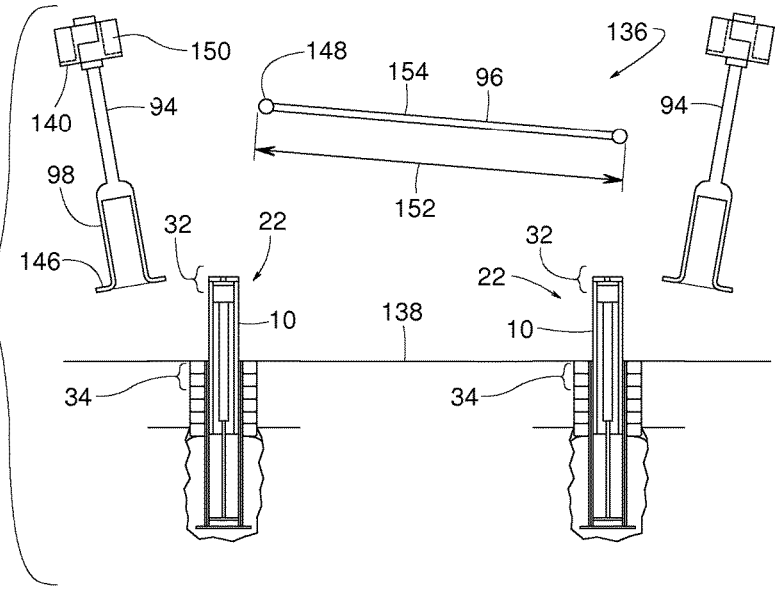
FIG. 27 is a cross-sectional view showing an example retractable bollard system (similar systems shown in FIGS. 21-23) but shown in a first configuration, wherein the example retractable bollard system is constructed in accordance with the teachings disclosed herein.
Figure 28:
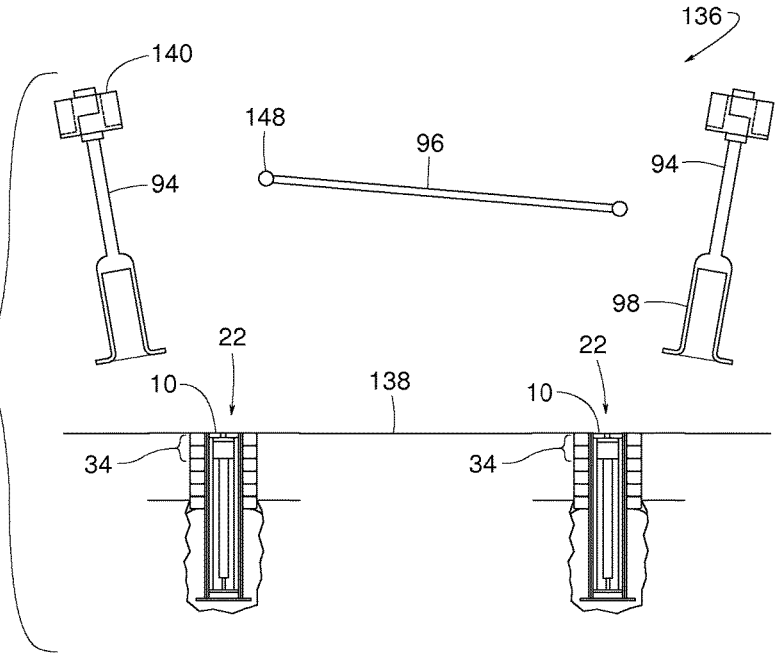
FIG. 28 is a cross-sectional view similar to FIG. 27 but showing the example retractable bollard system in a second configuration.

FIGS. 23-32 show an example retractable bollard system 136 similar to those described with reference to FIGS. 1-22. In some examples, the retractable bollard system 136 comprises at least one retractable bollard 22 with an associated post 10 being moveable selectively between the upper area 32 protruding above a support surface or floor 138 (e.g., above the surface 82 of the pavement 15) and the lower area 34 generally flush with the floor 138. In some examples, other parts of the retractable bollard system 136 include, the post extension 94, the handrail 96, and a handrail connector 140. As mentioned earlier, each post 10 is selectively moveable to upper area 32 (FIG. 27) and lower area 34 (FIG. 28).

Figure 30:
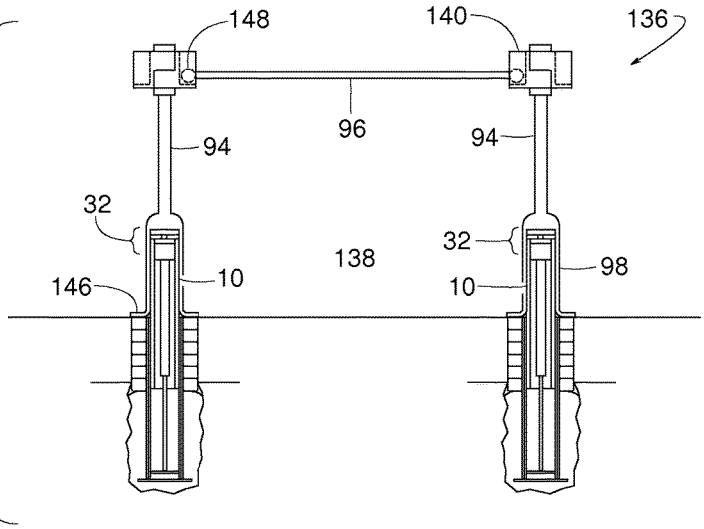
FIG. 30 is a cross-sectional view similar to FIG. 27 but showing the example retractable bollard system in a fourth configuration.
Figure 31:
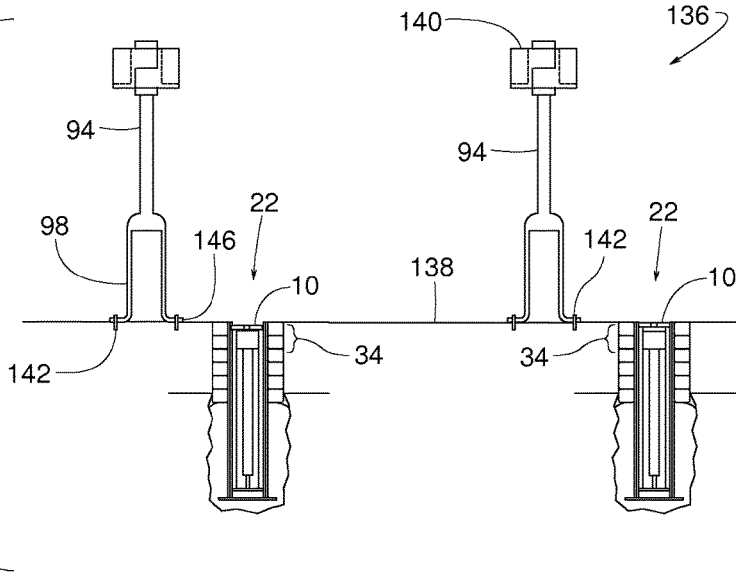
FIG. 31 is a cross-sectional view similar to FIG. 27 but showing the example retractable bollard system in a fifth configuration.
Figure 32:
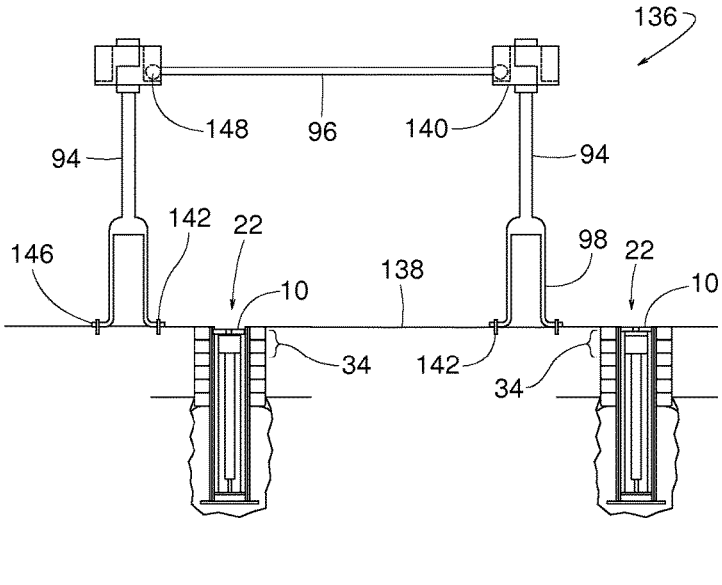
FIG. 32 is a cross-sectional view similar to FIG. 27 but showing the example retractable bollard system in a sixth configuration.
Figure 33:
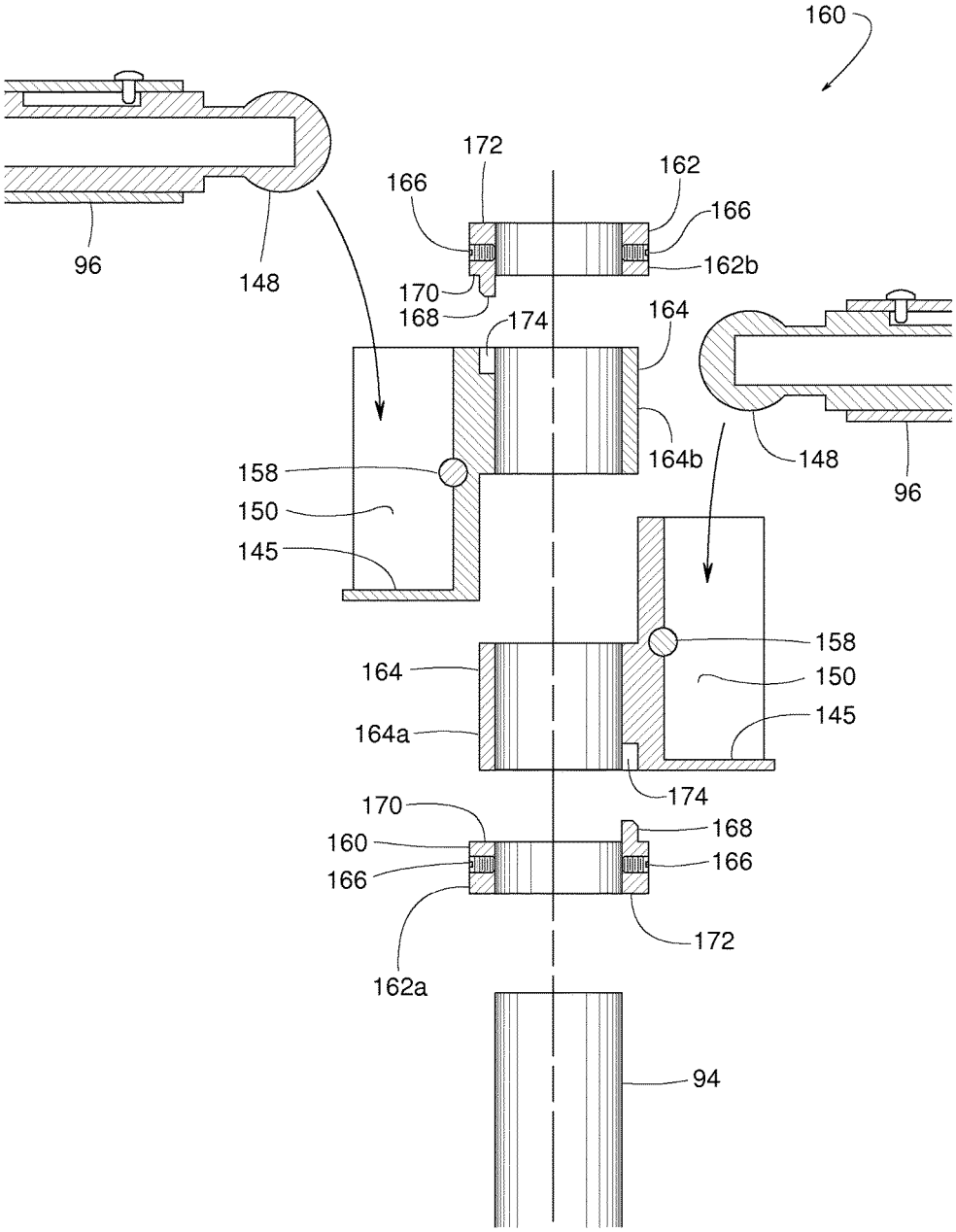
FIG. 33 is an exploded cross-sectional view of an example handrail connector assembly constructed in accordance with the teachings disclosed herein.

In some examples, each post extension 94 is movable selectively to a first mounting configuration (FIGS. 29 and 30) and a second mounting configuration (FIGS. 31 and 32). In the first mounting configuration (FIGS. 29 and 30), the post extensions 94 engage the posts 10. In the second mounting configuration (FIGS. 31 and 32), the post extensions 94 fasten directly to the floor 138. In some examples, as shown in FIGS. 31 and 32, one or more threaded fasteners 142 (e.g., anchor bolts) extend through holes 144 in a flange 146 that extends radially outward from the inverted cup 98. In some examples, the past extensions 94 in the second mounting configuration are spaced apart from the bollards 22 as shown in FIGS. 31 and 32. In other examples, the post extensions 94 may be anchored directly to the floor 138 (as in the second mounting configuration) while positioned over top of the bollards 22 (whether or not the post 10 is extended or retracted).

Figure 23:
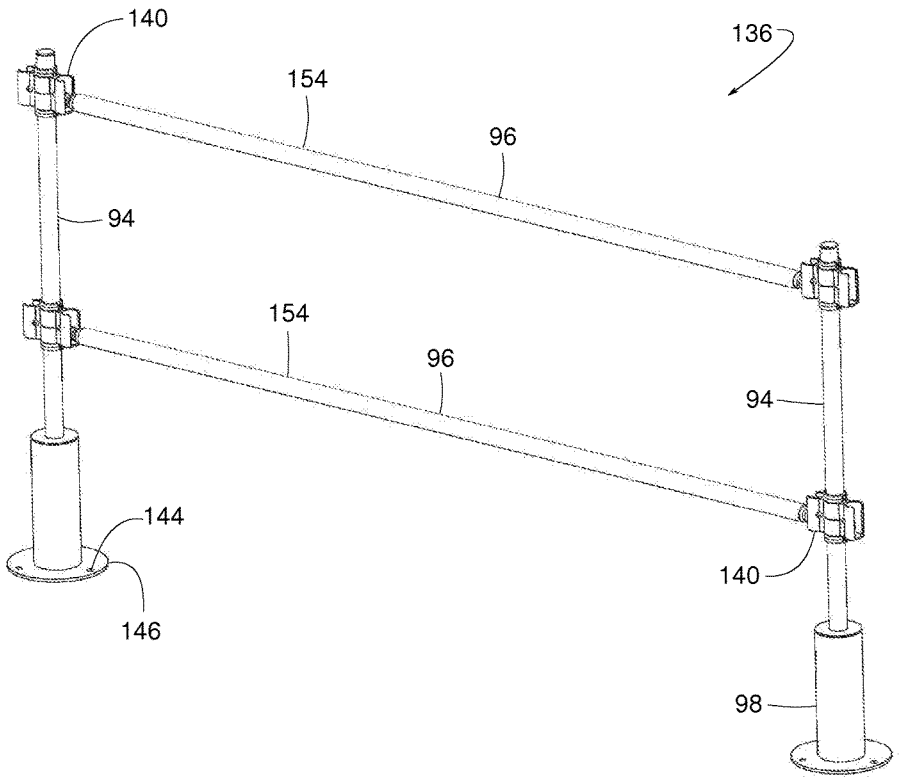
FIG. 23 is a perspective view of another example retractable bollard system (similar to the example shown in FIGS. 21 and 22) constructed in accordance with the teachings disclosed herein.
Figure 24:
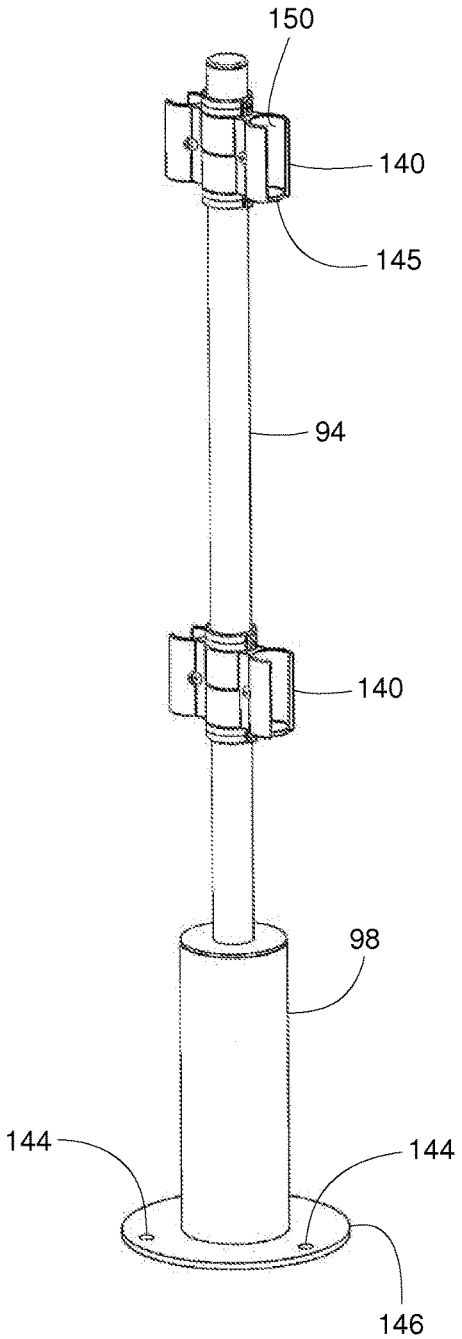
FIG. 24 is a perspective view of an example post extension used in the example retractable bollard system shown in FIG. 23.
Figure 25:
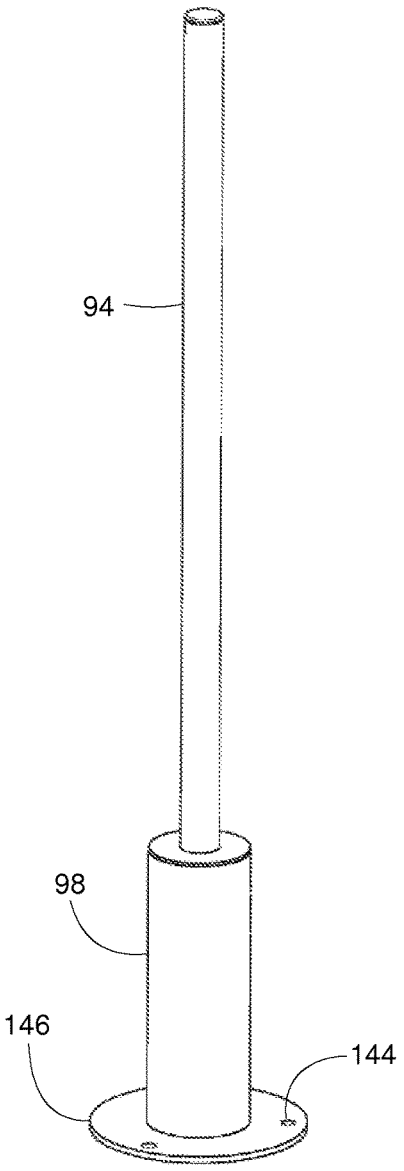
FIG. 25 is a perspective view similar to FIG. 24 but with the handrail connectors removed.

In the illustrated examples, one or more handrails 96 are selectively movable to an installed position (FIGS. 23, 30 and 32) attached to the post extension 94 and a removed position (FIGS. 27, 28, 29, and 31) spaced apart from the post extension 94. In some examples, to selectively attach and remove the handrail 96, a spherical end 148 of the handrail 96 and a mating socket 150 of the connector 140 provides a disconnectable ball-and-socket joint between the handrail 96 and the post extension 94. In some examples, the socket of the connector 140 is a vertically elongate channel. In some examples, a bottom plate 145 (support member) prevents the end 148 from falling down out through the bottom of the channel. In some examples, the handrail 96 has an extendible length 152 by virtue of one or more of its ends 148 being able to extend out from within a main central section 154 of the handrail 96, as indicated by arrow 156 (FIG. 26). The handrail's adjustable length 152 accommodates post and other misalignment and tolerance errors in the bollard system 136. Some examples of the connector 140 include a spring loaded retainer 158 that selectively holds and releases the end 148 of the handrail 96. In some examples, the retainer 158 is spring biased to normally retain the end 148 but can be manually actuated to release the end 148. In some examples, the connector 140 can be selectively attached to the post extension 94, as shown in FIG. 24, or removed from the post extension 94, as shown in FIG. 25. In some examples, for instance, the handrail 96 is not needed, and the post extension 94 is just used for providing a more prominent visual indication that the post 10 is extended above the floor 138.

In some examples, the retractable bollard system 136 is configurable selectively to multiple configurations including a first configuration (FIG. 27), a second configuration (FIG. 28), a third configuration (FIG. 29), a fourth configuration (FIG. 30), a fifth configuration (FIG. 31), and/or a sixth configuration (FIG. 32). FIG. 23 can be viewed as being in either the fourth configuration or the sixth configuration. FIG. 23 would represent the fourth configuration when the post extensions 94 engage the elevated posts 10. Alternatively, FIG. 23 would represent the sixth configuration when the post extensions 94 are attached directly to the floor 138 and spaced apart from any of the posts 10, elevated or retracted.

In the first configuration, shown in the illustrated example of FIG. 27, the post 10 is in the upper area 32 (e.g., the extended position) and is spaced apart from the post extension 94 and the handrail 96 (e.g., the post extension 94 and the handrail 96 are stored away and not being used). This configuration provides an effective barrier to vehicles while allowing pedestrians to pass through.

In the second configuration, shown in the illustrated example of FIG. 28, the post 10 is in the lower area 34 (e.g., the retracted position) and is spaced apart from the post extension 94 and the handrail 96 (e.g., the post extension 94 and the handrail 96 are stored away and not being used). This configuration allows both vehicles and pedestrians to pass.

Figure 29:
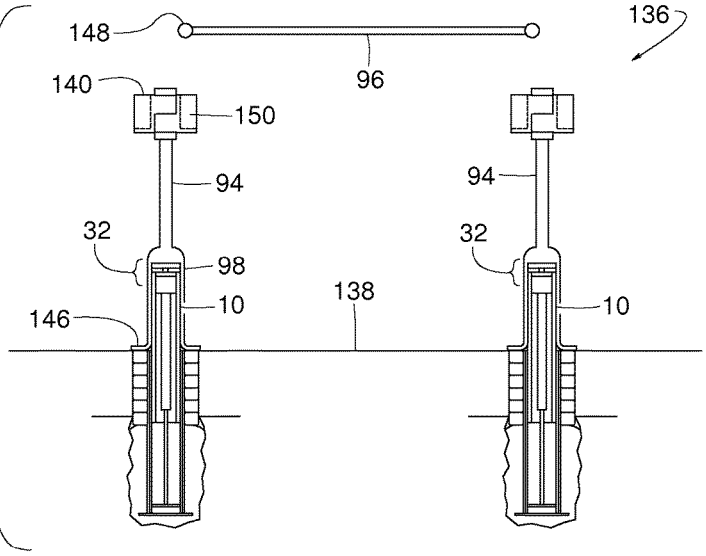
FIG. 29 is a cross-sectional view similar to FIG. 27 but showing the example retractable bollard system in a third configuration.

In the third configuration, shown in the illustrated example of FIG. 29, the post extension 94 is in the first mounting configuration engaging the post 10, and the handrail 96 is in the removed position spaced apart from the post extension 94 (e.g., the handrail 96 is stored away and not being used). This configuration allows pedestrians to pass between the post extensions 94 while the post extensions 94 provide prominent indicators that alert drivers that the posts 10 are raised and in position to block the passage of vehicles.

In the fourth configuration, as shown in the illustrated example of FIG. 30, each post extension 94 is in the first mounting configuration engaging the post 10, and the handrail 96 is in the installed position attached to the post extension 94. This configuration effectively blocks the passage of vehicles and pedestrians.

In the fifth configuration, shown in the illustrated example of FIG. 31, each post extension 94 is in the second mounting configuration fastened to the floor 138, and the handrail 96 is in the removed position spaced apart from the post extensions 94 (e.g., the handrail 96 is stored away and not being used). This configuration provides guide markers for pedestrians and/or vehicles without creating a broad solid obstruction. In some examples, for instance, it might be desirable to mark off a certain area while still allowing alerted pedestrians and vehicles to pass.

In the sixth configuration, shown in the illustrated example of FIG. 32, each post extension 94 is in the second mounting configuration fastened to the floor 138, and the handrail 96 is in the installed position attached to the post extensions 94. This configuration effectively blocks the passage of pedestrians without having to rely on the post 10 being raised or even present in the area. This allows the use of a long run of handrails 96 supported by a large number of post extensions 94 without having to incur the expense of an equally large number of retractable bollards 22.

In some examples, the connector 140 is part of a handrail connector assembly 160, which includes one or more invertible collars 162 (e.g., collars 162*a* and 162*b*) and one or more connectors 164 (e.g., connector 164*a* and 164*b*), as shown in FIGS. 33-38. In the illustrated example, the assembly 160 comprises a lower collar 162*a* (first collar), a lower connector 164*a* (first connector), an upper connector 164*b* (second connector), and an upper collar 162*b* (second collar). In some examples, a slip fit allows each of the lower and upper collars 162*a*, 162*b* and each of the lower and upper connectors 164*a*, 164*b* to be slid onto the post extension 94. Once slidingly positioned to any desired elevation along the post extension 94, setscrews 166 are tightened to hold the collars 162*a*, 162*b* in place with the connectors 164 stacked and confined between the collars 162*a*, 162*b*.

In the illustrated example, each collar 162 is invertible selectively to a lock position and a release position, and its position determines whether an adjacent connector 164 can rotate about the post extension 94. To achieve such function, some examples of the collar 162 have an anti-rotation key 168 protruding vertically from a first axial surface 170 of the collar 162 while an opposite facing second axial surface 172 has no such key. The key 168 is sized to matingly fit within a key slot 174 of the connector 164. As such, when a collar's key 168 extends into a key slot 174 of an adjacent connector 164, the collar 162 restrains or limits the rotation of that adjacent connector 164, provided the collar's setscrew 166 is tightened against the post extension 94.

It should be noted that the key 168 on the collar 162 mating with the key slot 174 in the connector 164 is just one example of locking the collar 162 to the connector 164. Other examples of equivalent function include a key on a connector protruding into a mating slot in an adjacent collar, a key protruding from something other than an axial surface of the collar, and mating serrations (or other mating features) on facing surfaces of a collar and a connector.

Figure 34:
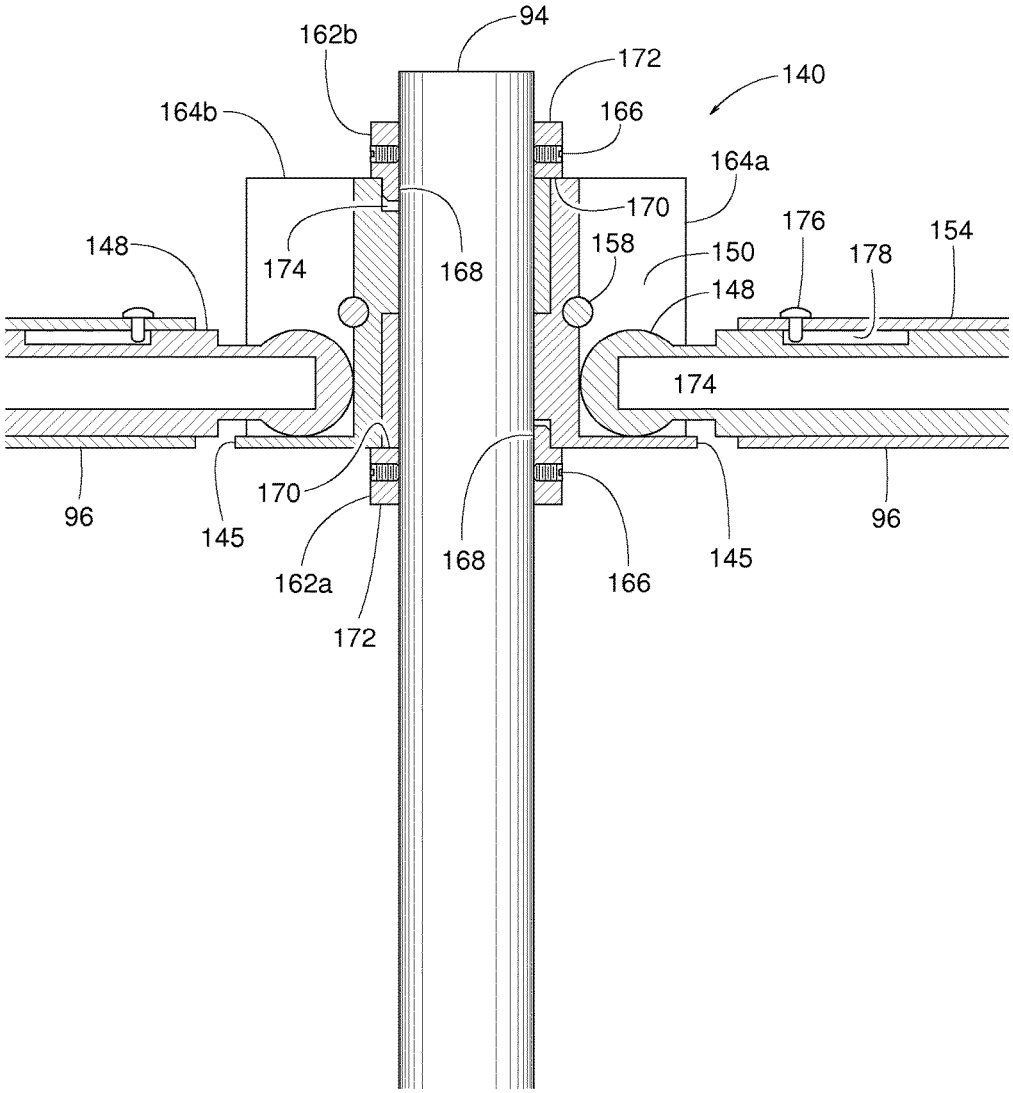
FIG. 34 is a cross-sectional view similar to FIG. 33 but showing the example handrail connector assembled in one configuration.

FIG. 34 shows each key 168 in a lock position protruding into the key's corresponding slot 174 of the adjacent connector 164. In the illustrated example, with the setscrews 166 tightened against the post extension 94, the lower collar 162*a* restricts the rotation of the lower connector 164*a* around the post extension 94. In a similar manner, the upper collar 162*b* restricts the rotation of the upper connector 164*b*. The illustrated example of FIG. 34 also shows the end 148 of the handrail 96 resting upon the bottom plate 145 with the retainer 158 positioned to capture the end 148 within the socket 150. In some examples, a protrusion 176 (e.g., a rivet, a screw, a pin, a key, etc.) extends into a slot 178 in the handrail 96 to limit the telescopic axial travel of the end 148 relative to the handrail's main central section 154.

Figure 35:
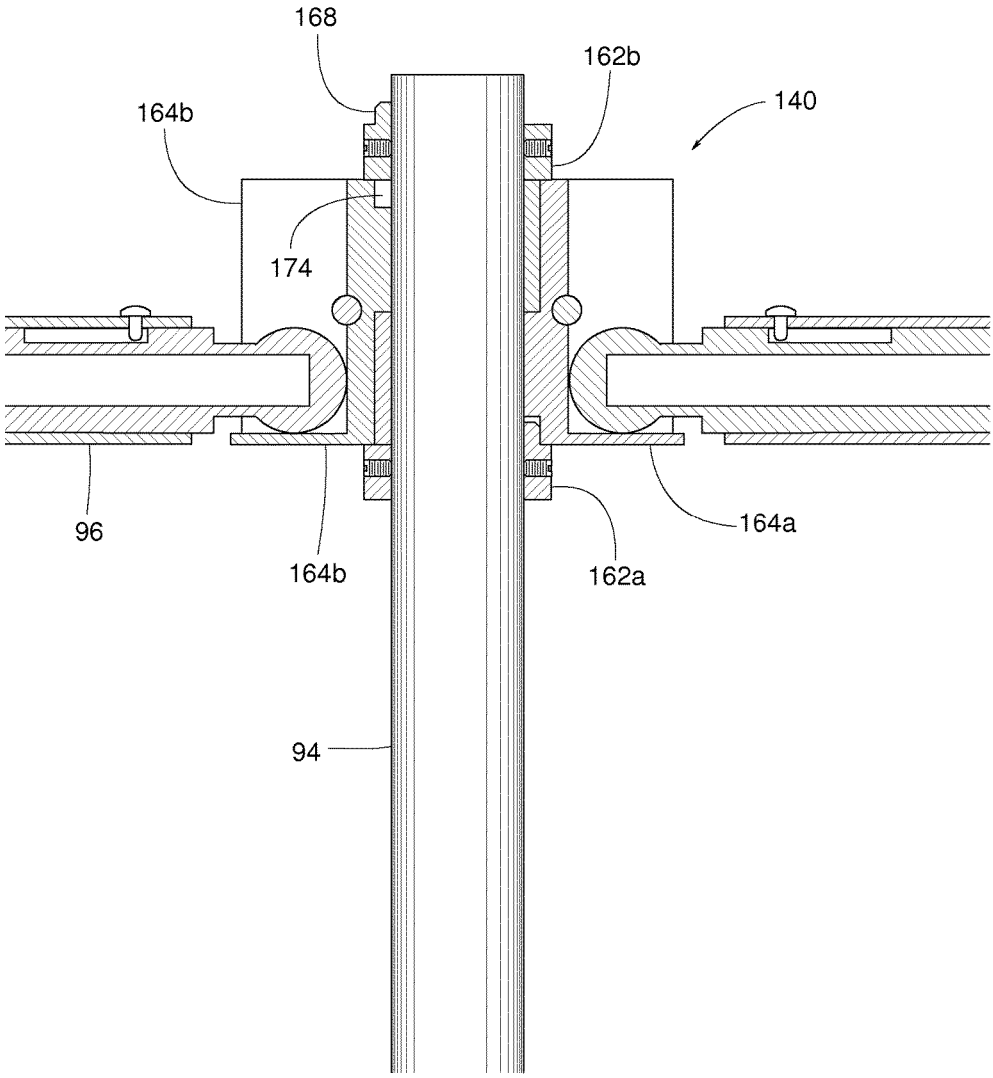
FIG. 35 is a cross-sectional view similar to FIG. 34 but showing another assembled configuration.

FIG. 35 shows the lower collar 162*a* in the lock position and the upper collar 162*b* in its release position. In the illustrated example, the lower collar 162*a* in the lock position restricts the rotation of the lower connector 164*a*. By contrast, with upper collar 162*b* in the release position, the key 168 is disengaged from the slot 174 in the upper connector 164*b* such that the upper collar does not restrict the rotation of the upper connector 164*b*. As a result, in some examples, the upper connector 164*b* is free to rotate about the post extension 94 to serve as a hinge that permits the left side handrail 96 to function as a gate that pivots about the post extension 94.

Figure 36:
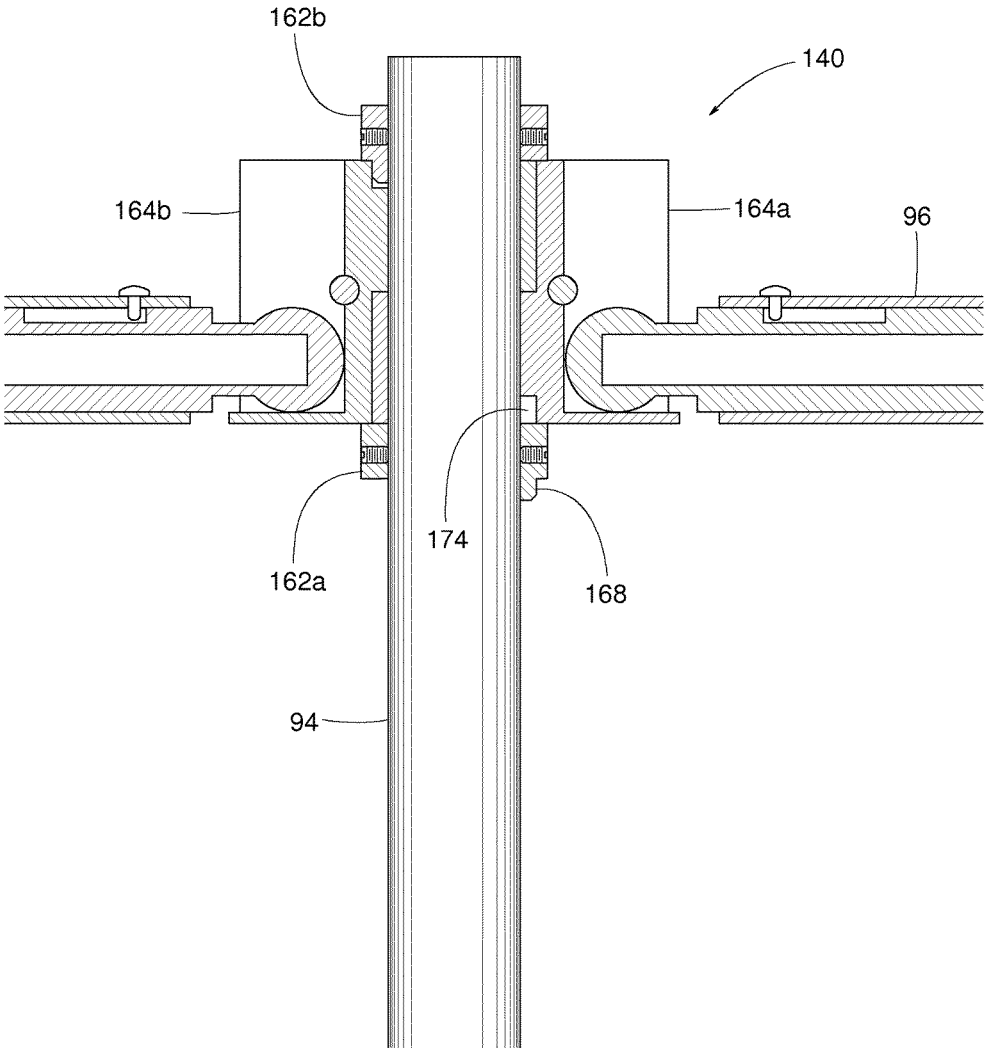
FIG. 36 is a cross-sectional view similar to FIGS. 34 and 35 but showing yet another assembled configuration.

FIG. 36 shows the upper collar 162*b* in the lock position and the lower collar 162*a* in the release position. In the illustrated example, the upper collar 162*b* in the lock position restricts the rotation of the upper connector 164*b*. By contrast, with lower collar 162*a* in the release position, the key 168 is disengaged from the slot 174 in the lower connector 164*a* such that the lower collar 162*a* does not restrict the rotation of the lower connector 164*a*. As a result, in some examples, the lower connector 164*a* is free to rotate about the post extension 94 to serve as a hinge that permits the right side handrail 96 to function as a gate that pivots about the post extension 94.

Figure 37:
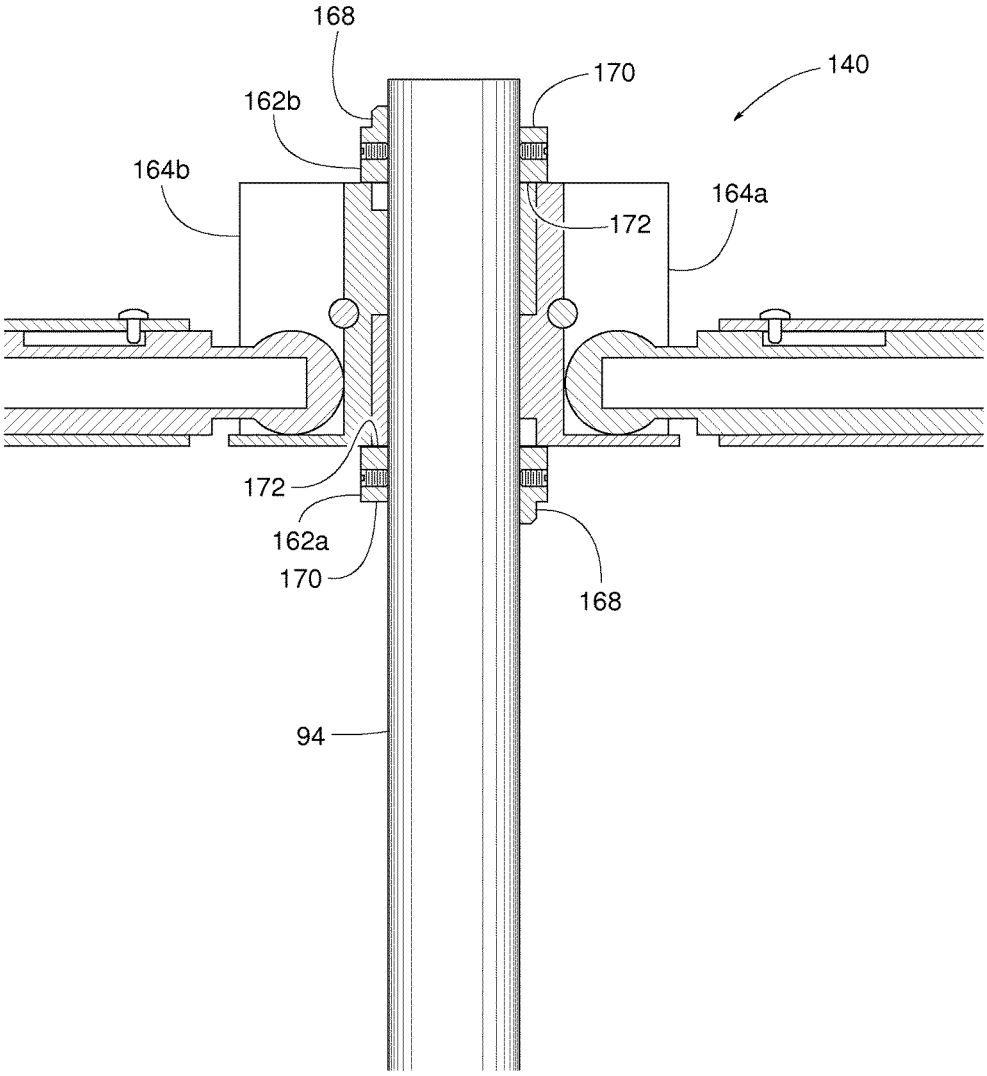
FIG. 37 is a cross-sectional view similar to FIGS. 34-36 but showing another assembled configuration.

In the illustrated example of FIG. 37, both collars 162*a*, 162*b* are in the release position. In such examples, neither collar 162 restricts the rotation of the corresponding connector 164*a*, 164*b*.

Figure 38:
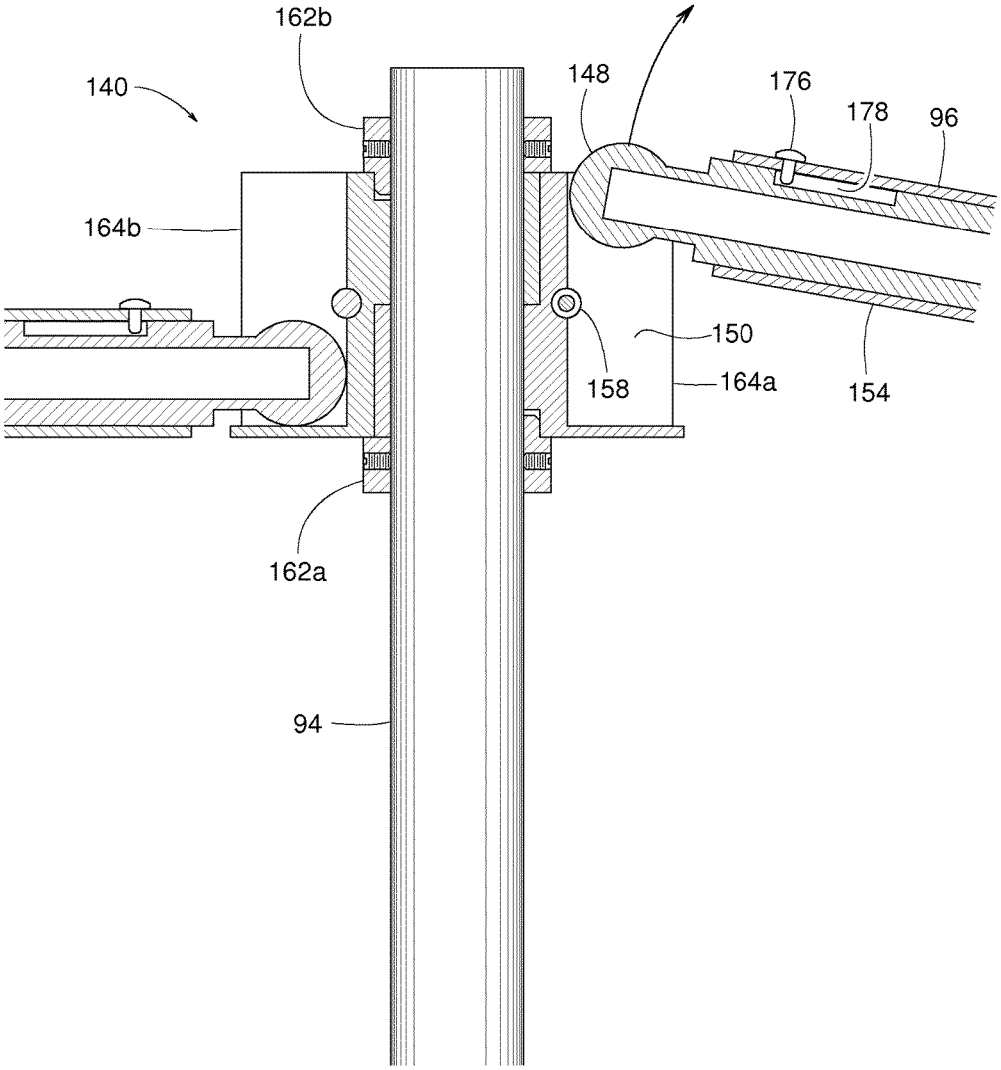
FIG. 38 is a cross-sectional view similar to FIGS. 34-37 but showing an example handrail being pivotally removed from the example connector assembly.

FIG. 38 shows the right-side retainer 158 having been manually depressed or otherwise moved to where the right-side handrail 96 can be tilted or otherwise lifted out from within the socket 150. The telescopic connection between the handrail's end 148 and the main central section 154 enables the upward pivotal removal of the handrail 96 without the end 148 binding within the socket 150.

Figure 39:
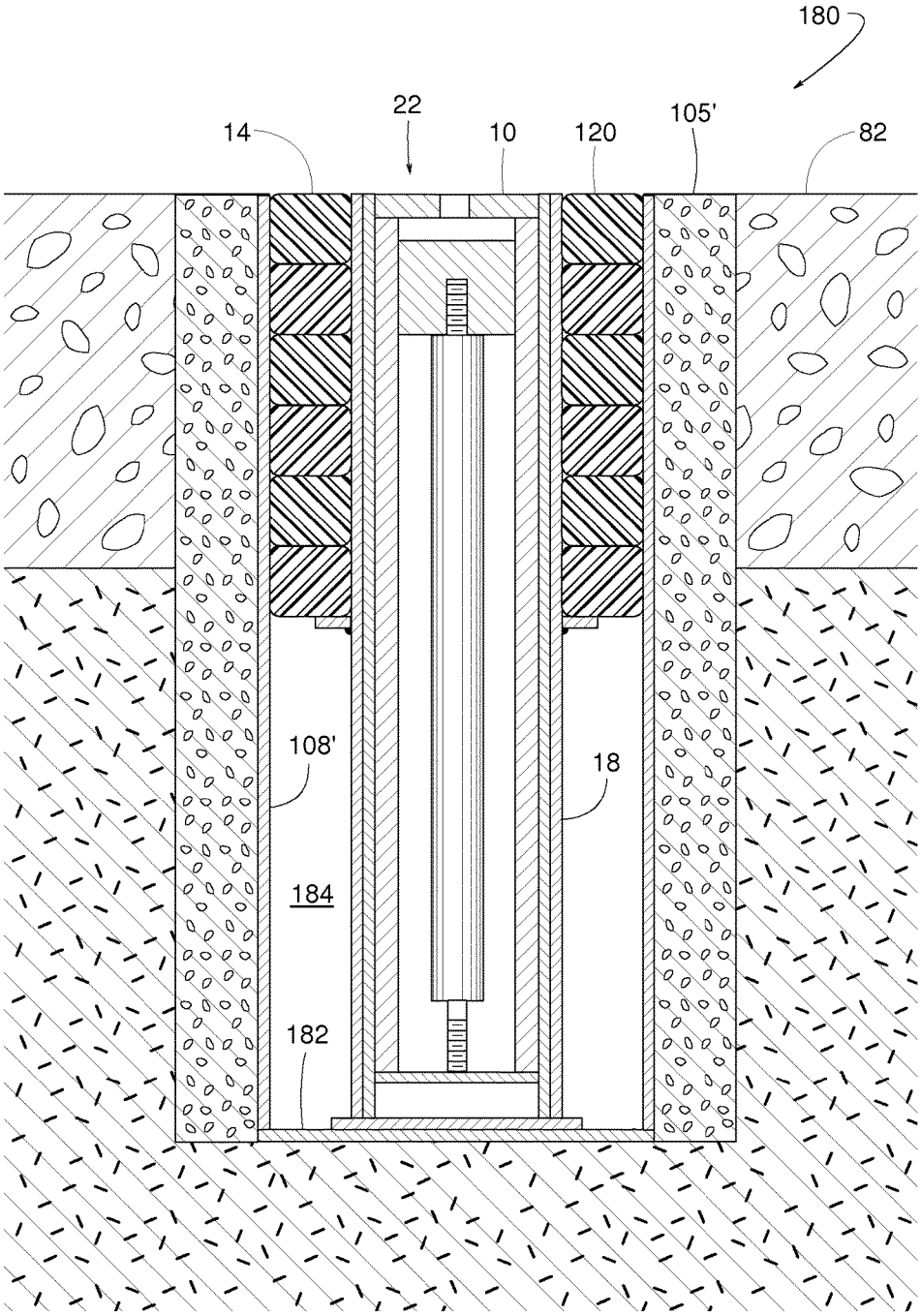
FIG. 39 is a cross-sectional view similar to FIG. 14 but showing another example retractable bollard system constructed in accordance with the teachings disclosed herein.

FIG. 39 shows an example retractable bollard system 180 similar to the bollard system 102 of FIG. 14; however, the bollard system 180 has a full length tubular liner 108', a thicker adhesive 105' (e.g., cement), and a bottom plate 182. In some such examples, cement 24 is omitted. Such an arrangement creates an annular gap 184 or void that provides the lower end of the bollard 22 with radial space into which it can shift in reaction to an accidental impact of an elevated post 10. In some examples, the annular gap 184 also provides the bollard 22 unrestricted freedom to return to its normally upright position after such an impact. In some examples, the adhesive 105' is thicker than adhesive 105 described above in connection with FIG. 14 and is thicker than the wall thickness of the ground sleeve 18 to make the bollard 22 easier to install.

Figure 40:
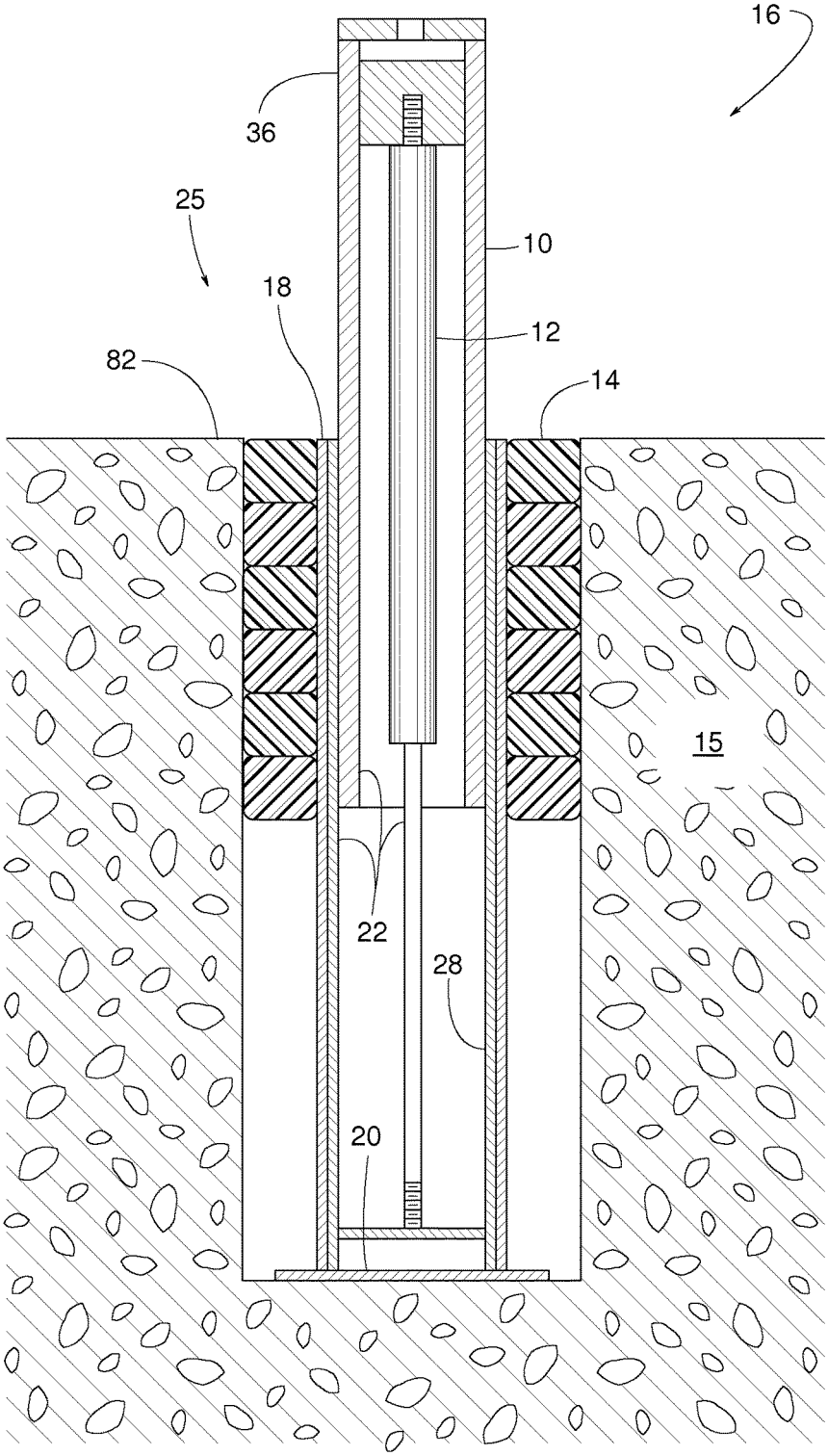
FIG. 40 is a cross-sectional view similar to FIG. 1 but showing another example installation in accordance with the teachings disclosed herein.
Figure 41:
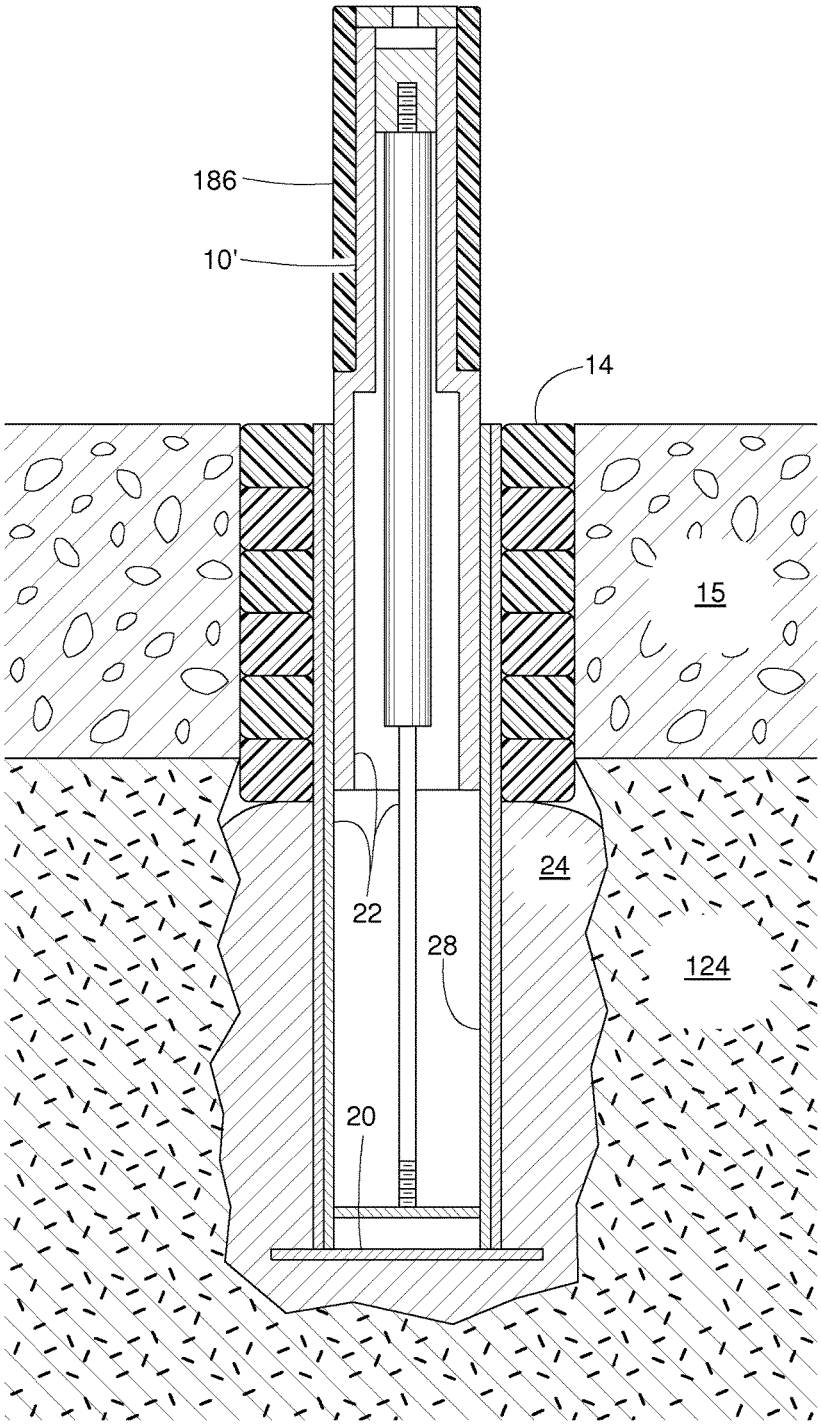
FIG. 41 is a cross-sectional view similar to FIG. 1 but showing another example post and shock absorber constructed in accordance with the teachings disclosed herein.
Figure 42:
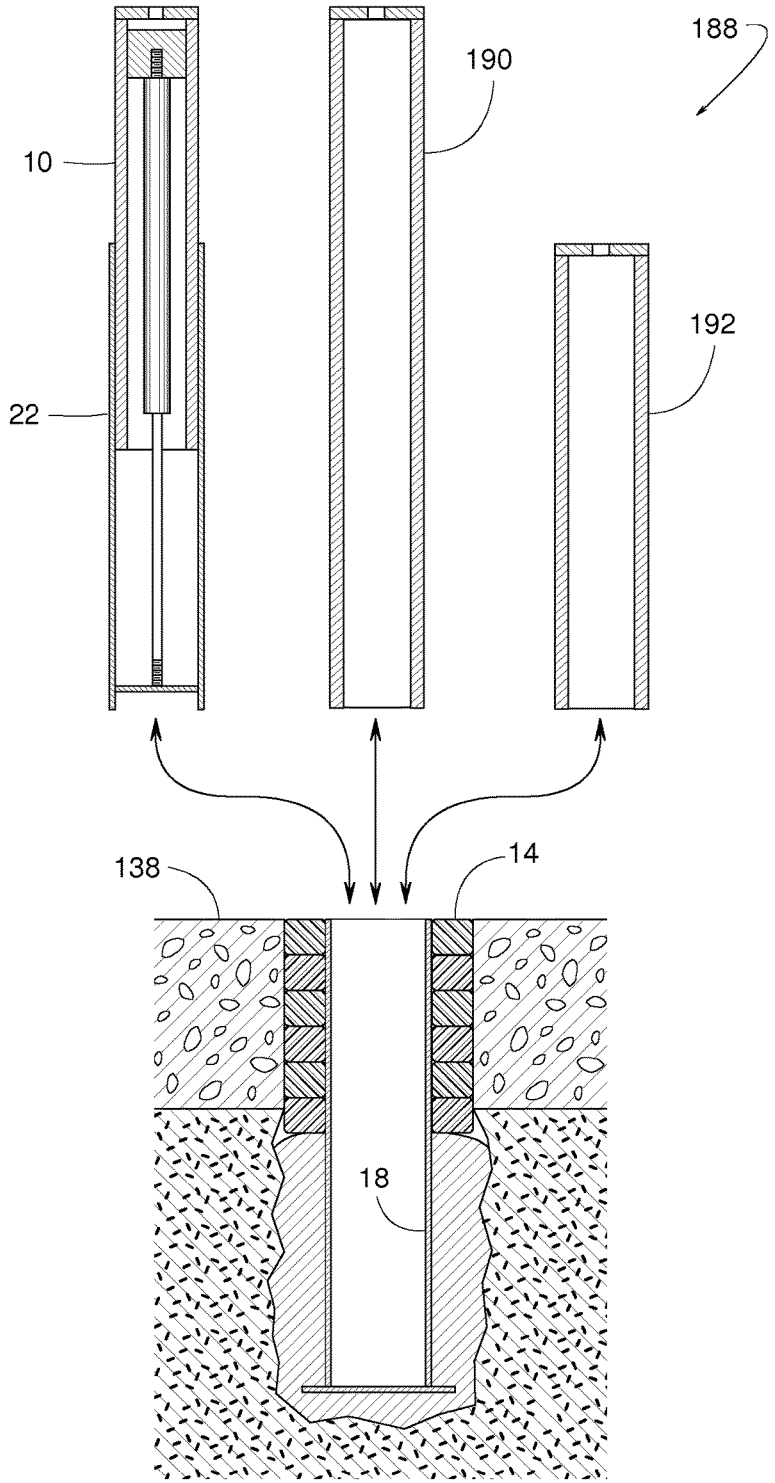
FIG. 42 is a cross-sectional view of an example bollard system configurable in accordance with the teachings disclosed herein.
Figure 43:
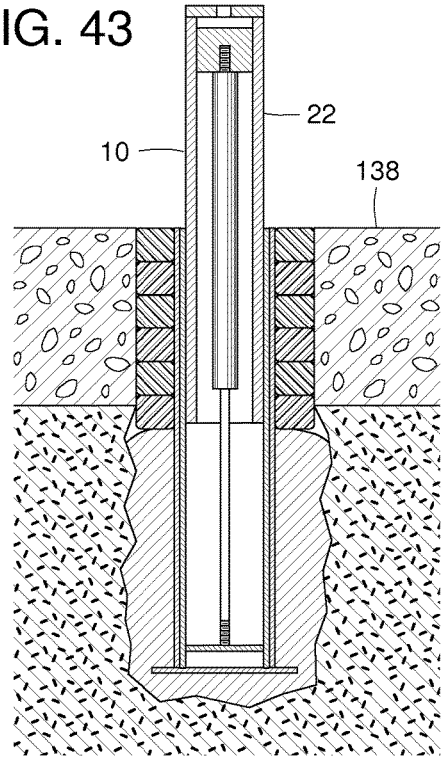
FIG. 43 is a cross-sectional view of the example bollard system shown in FIG. 42 in a first configuration.

In addition or alternatively, FIG. 40 shows an example retractable bollard system 16 embedded entirely within pavement 15 without touching any underlying ground material 124. FIG. 41 shows a polymeric shock absorber 186 encircling and engaging a post 10'. In the event of an accidental impact, the example shock absorber 186 helps protect post 10' and/or an attached post extension 94 from damage. In the illustrated example, the shock absorber 186 is a cylinder with an outer diameter that is sufficiently small to retract within the shell 28 when the post 10' is retracted. In some examples, the shock absorber 186 has an outer diameter that is too large to retract within shell 28. Consequently, such example shock absorbers are removed from the post 10' upon or prior to the post 10' retracting. In some examples, the shock absorber 186 is a series of polymeric rings stacked in an arrangement similar to that of the shock absorber 14.

Figure 44:
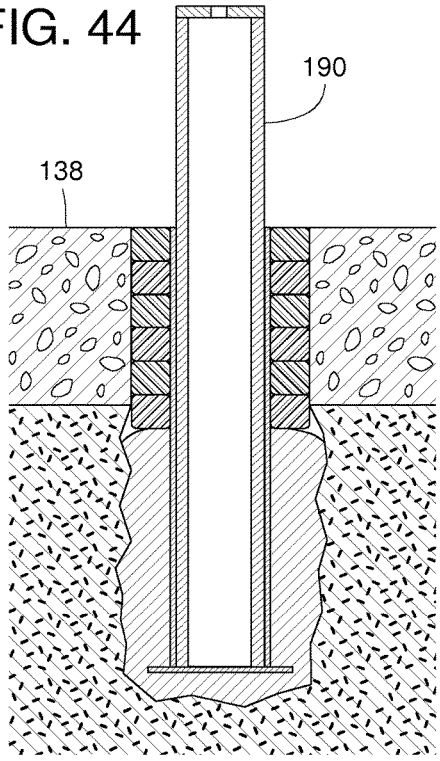
FIG. 44 is a cross-sectional view of the example bollard system shown in FIG. 42 in a second configuration.
Figure 45:
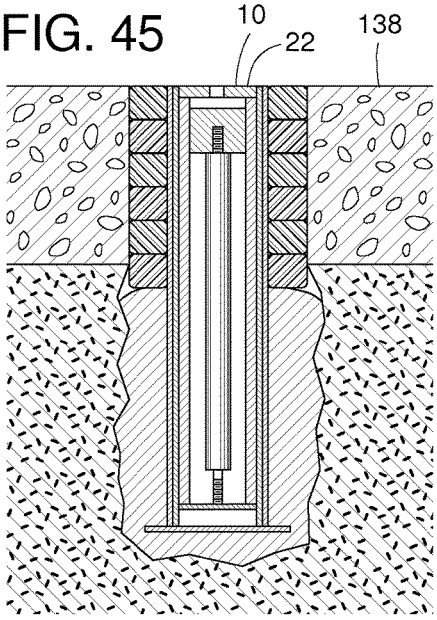
FIG. 45 is a cross-sectional view of the example bollard system shown in FIG. 42 in a third configuration.
Figure 46:
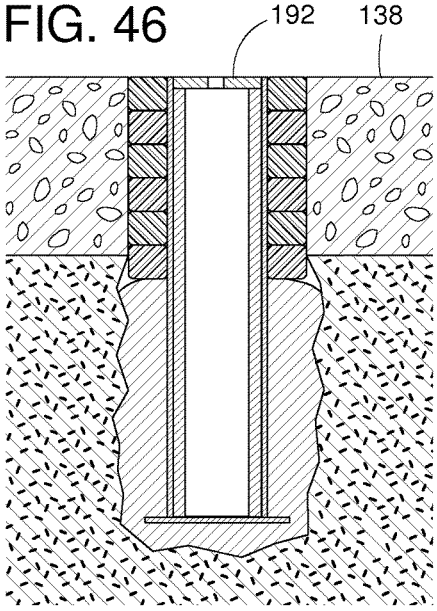
FIG. 46 is a cross-sectional view of the example bollard system shown in FIG. 42 in a fourth configuration.

FIGS. 42-46 show an example bollard system 188 providing selectively a first configuration (FIG. 43), a second configuration (FIG. 44), a third configuration (FIG. 45), and a fourth configuration (FIG. 46). In the illustrated example, the ground sleeve 18 can receive the selectively retractable bollard 22, a tall fixed bollard 190 (first fixed bollard), and a short fixed bollard 192 (second fixed bollard). As explained earlier, in some examples, the post 10 of the retractable bollard 22 can be selectively raised (FIG. 43) and lowered (FIG. 45). Tall fixed bollard 190 remains elevated, as shown in FIG. 44. In some examples, the fixed bollards 190, 192 are made of a steel pipe. In some examples, the fixed bollards 190, 192 are made of a solid steel rod. In some examples, each of the fixed bollards 190, 192 is constructed of an assembly of pieces but having basically no moving parts. In some examples, the short fixed bollard 192 is dimensioned to be generally flush with the floor 138 when installed within the ground sleeve 18, as shown in FIG. 46. The bollard system 188 provides cost-effective options for meeting the needs of various users. In some examples, the tool 64 can assist in extracting the short bollard 192.

In some examples, the bollard system 188 comprises: the ground sleeve 18 extending below the floor 138; a retractable bollard 22 having a variable length ranging from a retracted length (FIG. 45) to an extended length (FIG. 43), the retractable bollard 22 being selectively insertable into the ground sleeve 18; a first bollard 190 being of a first length that is substantially fixed (e.g., the first bollard 190 is a rigid post), the first bollard 190 being selectively insertable into the ground sleeve 18; and a second bollard 192 being of a second length that is substantially fixed (e.g., the second bollard 192 is a rigid post), the second bollard 192 being selectively insertable into the ground sleeve, the first length being greater than the second length, and the retracted length being substantially equal to the second length. In some examples, a polymeric shock absorber 14 encircles the ground sleeve 18. In some examples, an uppermost surface of the second bollard 192 is substantially flush with floor 138 when inserted into the ground sleeve 18, as shown in FIG. 46.

Although certain example methods, apparatus and articles of manufacture have been described herein, the scope of the coverage of this patent is not limited thereto. On the contrary, this patent covers all methods, apparatus and articles of manufacture fairly falling within the scope of the appended claims either literally or under the doctrine of equivalents.

What is claimed is:

1. A retractable bollard system for installation in a support surface that includes pavement, the retractable bollard system comprising:

a shell that when installed in the support surface extends below an upper surface of the pavement;

a post telescopically coupled to the shell, the post being axially movable relative to the shell selectively to an upper area and a lower area, wherein in the upper area, the head of the post is above a top of the shell, and in the lower area, the head of the post is proximate the top of the shell, the post extending farther above the shell when the post is in the upper area than when the post is in the lower area;

a spring to urge the post from the lower area toward the upper area, wherein, when the head of the post is in the upper area, the post is rotatable relative to the shell selectively between a locked position and an unlocked position, the locked position being higher than the unlocked position; and a shock absorber to encircle the shell, the shock absorber made of a polymeric material.

2. The retractable bollard system of claim 1, further including:

a ground sleeve to encircle the shell and the post; and cement to anchor the ground sleeve when the retractable bollard system is installed in the support surface, wherein a telescopic sliding fit between the shell and the ground sleeve enables the shell and the post to be slidingly removable out from within the ground sleeve while the ground sleeve remains anchored in place.

3. The retractable bollard system of claim 2, wherein the shock absorber is to encircle the ground sleeve, the shell and the post.

4. The retractable bollard system of claim 2, wherein the cement anchors the ground sleeve in place, but the cement is spaced apart from the pavement.

5. The retractable bollard system of claim 2, further including a shoulder disposed on the ground sleeve, the shoulder to engage the shock absorber.

6. The retractable bollard system of claim 5, wherein the shoulder is lower than a bottom surface of the pavement.

7. The retractable bollard system of claim 1, wherein the shock absorber extends lower than a bottom surface of the pavement.

8. The retractable bollard system of claim 1, wherein the shock absorber includes a plurality of stacked polymeric rings.

9. The retractable bollard system of claim 1, wherein the shock absorber includes a plurality of stacked polymeric rings including a top ring and a lower ring, and the top ring is softer than the lower ring.

10. The retractable bollard system of claim 1, wherein the shock absorber includes a plurality of stacked polymeric rings including a first ring and a second ring, and the first ring is thinner than the second ring.

11. The retractable bollard system of claim 1, further including:

a tubular liner to encircle the shell, the tubular liner to be radially spaced apart from the shell to create an annular gap between the shell and an inner perimeter of the tubular liner; and an adhesive to bond an outer perimeter of the tubular liner to the pavement, the shock absorber is to be disposed within the annular gap.

12. The retractable bollard system of claim 11, wherein the adhesive includes cement.

13. The retractable bollard system of claim 1, wherein, when the head of the post is in the lower area, the post is rotatable relative to the shell selectively between a stored position and a released position, the stored position being higher than the released position.

14. The retractable bollard system of claim 1, wherein the shell and the post correspond to a first retractable bollard, the retractable bollard system further including:

a second retractable bollard substantially identical to and spaced apart from the first retractable bollard; and a handrail to extend from the first retractable bollard to the second retractable bollard, the handrail to be vertically spaced apart from the pavement.

15. The retractable bollard system of claim 1, further including a polymeric shock absorber encircling and engaging the post.

16. The retractable bollard system of claim 13, further including:

a guide surface to be vertically elongate and having an upper end stop and a lower end stop; and a guide follower to engage the guide surface and being movable relative to the guide surface over a full travel length from the lower end stop to the upper end stop, at least one of the guide surface or the guide follower being substantially fixed relative to the post, the guide follower engaging the guide surface defining a path of movement of the post as the post moves selectively to the locked position, the unlocked position, the stored position and the released position.

17. The retractable bollard system of claim 16, wherein the guide surface corresponds to a slot in the shell, and the guide follower is a protrusion extending from the post into the slot.

18. The retractable bollard system of claim 16, further including a tool for manually rotating the post between the stored position and the released position, for manually moving the post between the upper area and the lower area, and for manually rotating the post between the unlocked position and the locked position, the tool including a handle, a shank and an extremity, the shank extending between the handle and the extremity, the tool having selectively an engaged position and a disengaged position, the extremity engaging the post when the tool is in the engaged position, and the extremity being spaced apart from the post when the tool is in the disengaged position.

19. The retractable bollard system of claim 1, wherein the post is a retractable post, the retractable bollard system further including:

a first fixed post having a first length;

a second fixed post having a second length, the first length greater than the second length; and a ground sleeve to be installed within a ground and to selectively hold at least one of the post, the first fixed post, or the second fixed post, at least one of the first fixed post or the second fixed post slidingly fitting within the ground sleeve to rest on an anchor plate at a base of the ground sleeve when inserted in the ground sleeve, a top surface of the second fixed post being substantially flush with an upper surface of the ground when inserted within the ground sleeve.

20. The retractable bollard system of claim 19, wherein a distance between the anchor plate and the head of the post is approximately the first length when the head of the post is positioned in the lower area and approximately the second length when the head of the post is positioned in the upper area.

21. The retractable bollard system of claim 19, wherein the shock absorber is to be substantially flush with the upper surface of the ground and to extend a depth into the ground greater than a depth of surrounding pavement.

22. The retractable bollard system of claim 21, wherein the shock absorber is to rest upon cement anchoring the ground sleeve in the ground.

23. The retractable bollard system of claim 22, further including a shoulder extending radially outward of the ground sleeve, the shock absorber to be supported by the shoulder.

24. The retractable bollard system of claim 19, wherein the top surface of the second fixed post includes a slot to enable a tool to selectively insert or remove the second fixed post from within the ground sleeve.

25. A retractable bollard system for installation in a support surface that includes pavement, the retractable bollard system comprising:

a shell that when installed in the support surface extends below an upper surface of the pavement;

a post to be telescopically coupled to the shell, the post being axially movable relative to the shell selectively to an upper area and a lower area, the post extending farther above the shell when the post is in the upper area than when the post is in the lower area; and a shock absorber to encircle the shell, the shock absorber made of a polymeric material, wherein the shock absorber includes a plurality of stacked polymeric rings including a first ring and a second ring, and the first ring is softer than the second ring.

* * * * *